US011653768B2

(12) United States Patent
Miller et al.

(10) Patent No.: US 11,653,768 B2
(45) Date of Patent: May 23, 2023

(54) BED HANDLE

(71) Applicant: Stander Inc., Logan, UT (US)

(72) Inventors: F. Troy Miller, Logan, UT (US); Kip Darrin Alder, Nibley, UT (US)

(73) Assignee: Stander Inc., Logan, UT (US)

( * ) Notice: Subject to any disclaimer, the term of this patent is extended or adjusted under 35 U.S.C. 154(b) by 0 days.

(21) Appl. No.: 17/455,752

(22) Filed: Nov. 19, 2021

(65) Prior Publication Data

US 2022/0160142 A1 May 26, 2022

Related U.S. Application Data

(60) Provisional application No. 63/116,441, filed on Nov. 20, 2020.

(51) Int. Cl.
*A47C 21/08* (2006.01)

(52) U.S. Cl.
CPC ..... *A47C 21/08* (2013.01)

(58) Field of Classification Search
CPC ..... A47C 21/08; A61G 77/0507; A61G 77/0508; A61G 77/051; A61G 77/0512; A61G 77/0513; A61G 77/0514; A61G 77/0515; A61G 77/0516; A61G 77/0518; A61G 77/0521; A61G 77/053
See application file for complete search history.

(56) References Cited

U.S. PATENT DOCUMENTS 2,159,323 A 7/1937 John
2,722,017 A 11/1955 Burst
3,220,024 A 8/1963 Nelson
3,289,223 A 10/1964 Oja
3,179,957 A 4/1965 Norton
3,262,133 A 7/1966 Beitzel
3,372,405 A 3/1968 Doering
3,553,746 A 1/1971 Seiger
3,905,591 A 9/1975 Schorr et al.
4,186,456 A 2/1980 Huempfner
(Continued)

FOREIGN PATENT DOCUMENTS

EP 2617404 A1 * 7/2013 ..... A61G 7/0507
EP 3632389 A1 4/2020
GB 115980 5/1918

OTHER PUBLICATIONS

International Search Report dated Mar. 15, 2022 for PCT/US2021/060149.
(Continued)

*Primary Examiner* — Robert G Santos
*Assistant Examiner* — Adam C Ortiz
(74) *Attorney, Agent, or Firm* — Dorsey & Whitney LLP

(57) ABSTRACT

A detachable bed handle providing support and mobility assistance for a user on a bed or similar furniture is disclosed. The detachable bed handle may couple with a base portion that can be mounted on a bed frame or bed base, or be positioned between a mattress and a box spring or bed base. The bed may be an adjustable (articulating) bed. The bed handle may have a gripping member that is shaped so as to avoid areas of potential entrapment of a user's body between the bed handle and the bed. Entrapment areas can be avoided both when the bed is in a nonarticulated state and when the bed is in an articulated state.

20 Claims, 22 Drawing Sheets

(56) References Cited

U.S. PATENT DOCUMENTS

| | | | |
|---|---|---|---|
| 4,259,756 | A | 4/1981 | Pace |
| 4,357,881 | A | 11/1982 | De Long |
| 4,446,796 | A | 5/1984 | Wilson et al. |
| 4,724,559 | A | 2/1988 | Bly et al. |
| 4,771,492 | A | 9/1988 | Paine et al. |
| 5,129,116 | A | 7/1992 | Borders |
| 5,257,426 | A | 11/1993 | Leoutsakos |
| 5,448,791 | A | 9/1995 | Brown |
| 5,640,726 | A | 6/1997 | Fishner-Rathus |
| 5,678,267 | A | 10/1997 | Kinder |
| 6,058,531 | A | 5/2000 | Carroll |
| 6,138,301 | A | 10/2000 | Battiston |
| 6,244,285 | B1 | 6/2001 | Gamache |
| 6,401,280 | B1 | 6/2002 | Baker |
| 6,519,794 | B1 | 2/2003 | Aarestad et al. |
| 6,560,794 | B2 | 5/2003 | Allen et al. |
| 6,618,877 | B2 | 9/2003 | Stephen |
| 7,013,508 | B2 | 6/2006 | Wu |
| 7,103,928 | B1 | 9/2006 | Childs |
| 7,197,779 | B2 | 4/2007 | Shalikar |
| 7,373,679 | B2 | 5/2008 | Miller |
| 7,467,434 | B1 | 12/2008 | Kunde et al. |
| 7,568,249 | B1 | 8/2009 | Kunde et al. |
| 7,617,552 | B2 | 11/2009 | Strickland |
| 7,797,775 | B2 | 9/2010 | Miller |
| 7,996,938 | B1 | 8/2011 | Calmes et al. |
| D692,702 | S | 11/2013 | Miller |
| 8,578,531 | B2 | 11/2013 | Abernathey et al. |
| 8,607,389 | B1 | 12/2013 | Kunde |
| D701,069 | S | 3/2014 | Miller |
| D702,073 | S | 4/2014 | Miller |
| D708,467 | S | 7/2014 | Zakel |
| D798,641 | S | 10/2017 | Miller |
| 9,980,574 | B2 | 5/2018 | Abraham et al. |
| D909,805 | S | 2/2021 | Kunde et al. |
| 2004/0158923 | A1 | 8/2004 | Perez et al. |
| 2006/0085914 | A1 | 4/2006 | Peterson et al. |
| 2006/0101578 | A1 | 5/2006 | Shalikar |
| 2007/0039100 | A1 | 2/2007 | Hensley et al. |
| 2014/0047640 | A1 | 2/2014 | Kullman |
| 2015/0216750 | A1 | 8/2015 | Miller |
| 2018/0116886 | A1 | 5/2018 | Miller |
| 2020/0093670 | A1 | 3/2020 | Miller |
| 2022/0160142 | A1 | 5/2022 | Miller et al. |

OTHER PUBLICATIONS

International Search Report and Written Opinion dated Dec. 2, 2019 for PCT/US2019/052219.

Notice of Allowance dated Mar. 4, 2008 for U.S. Appl. No. 11/252,675.

Notice of Allowance dated May 17, 2010 for U.S. Appl. No. 12/244,541.

Office Action dated Jan. 19, 2010 for U.S. Appl. No. 12/244,541.

Office Action dated Aug. 3, 2020 for U.S. Appl. No. 16/137,142.

Office Action dated Oct. 10, 2007 for U.S. Appl. No. 11/252,675.

* cited by examiner

BED HANDLE

RELATED CASES

This application claims priority to U.S. Provisional Application No. 63/116,441, filed on Nov. 20, 2020 and titled "BED HANDLE," which is hereby incorporated by reference in its entirety.

TECHNICAL FIELD

The present disclosure relates generally to the field of mobility assistance devices. More particularly, the present disclosure relates to mobility assistance devices such as bed rails and bed handles that can assist individuals getting into, getting out of, and positioning themselves on beds, including articulating beds.

BRIEF DESCRIPTION OF THE DRAWINGS

The written disclosure herein describes illustrative embodiments that are non-limiting and non-exhaustive. Reference is made to certain of such illustrative embodiments that are depicted in the figures, in which.

DETAILED DESCRIPTION

Figure 1B:
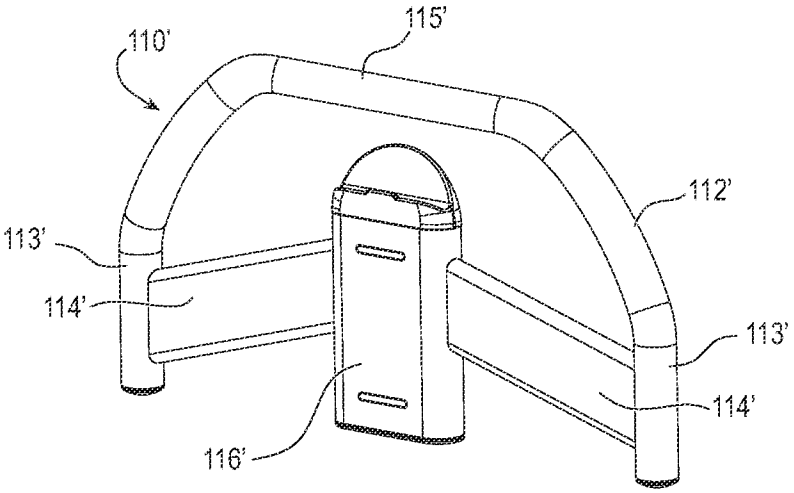
FIG. 1B is a perspective view of an embodiment of a bed handle.

The components of the embodiments as generally described and illustrated in the figures herein can be arranged and designed in a wide variety of different configurations. Thus, the following more detailed description of various embodiments, as represented in the figures, is not intended to limit the scope of the present disclosure, but is merely representative of various embodiments. While various aspects of the embodiments are presented in drawings, the drawings are not necessarily drawn to scale unless specifically indicated.

The phrase "coupled to" is broad enough to refer to any suitable coupling or other form of interaction between two or more entities, including mechanical interaction. Thus, two components may be coupled to each other even though they are not in direct contact with each other. The phrases "attached to" or "attached directly to" refer to interaction between two or more entities that are in direct contact with each other and/or are separated from each other only by a fastener of any suitable variety (e.g., mounting hardware or an adhesive).

References to approximations are made throughout this specification, such as by use of the term "substantially." For each such reference, it is to be understood that, in some embodiments, the value, feature, or characteristic may be specified without approximation. For example, where qualifiers such as "about" and "substantially" are used, these terms include within their scope the qualified words in the absence of their qualifiers. For example, where the term "substantially perpendicular" is recited with respect to a feature, it is understood that in some embodiments the feature may have a precisely perpendicular configuration.

The term "bed" includes articulating beds and regular beds. The term "regular bed" means a traditional bed that remains static in a flat state across the entire length of the bed.

The term "articulating bed" means an adjustable bed that has two or more sections across the length of the bed, at least one of which can be raised or lowered independently of the other sections. For example, one variant of an articulating bed can have a head section that can raise to an angled position higher than a foot section. The angle that the sections form can range from a large obtuse angle (given a small amount of articulation) to a near-right angle (given a large amount of articulation). As another example, an articulating bed can have four sections: a head section that might be angled upward, a torso section that might remain level, a thigh section that might angle upward in an opposite direction from the head section, and a foot section that might remain level or might be angled a different amount and/or a different direction from the thigh section. Sections of an articulating bed that remain level (whether by design or by following instructions for use) are herein called nonarticulating sections. Sections of an articulating bed that are raised or lowered to variable angles are herein called articulating sections.

The articulating sections of an articulating bed rotate about axes of rotation that separate the sections. For example, an articulating bed with two sections has an axis of rotation that separates the two sections, at least one of which articulates. As another example, an articulating bed with four sections may have three axes of rotation, with each axis of rotation separating two adjacent sections. The axes of rotation are generally aligned in a lateral direction.

The terms "articulated state" and "articulated position" mean a position in which an articulating bed is not in a flat state. The terms "nonarticulated state" and "nonarticulated position" mean a position in which a bed is flat across the entire length of the bed.

The term "lateral" refers to a direction spanning across the width of a bed, from side to side. The term "longitudinal" refers to a direction spanning across the length of a bed, from head to foot. A longitudinal direction and a lateral direction are substantially perpendicular to each other, and each is substantially perpendicular to a vertical direction.

The term "lateral plane" means a plane perpendicular to a lateral direction. A lateral plane therefore includes a vertical axis and a longitudinal axis.

The term "surface plane" means a plane that substantially encompasses an upper surface of a section of a mattress (neglecting small variations due to tufting, quilting, wrinkles, folds, or irregularities in the mattress or the bedding on the mattress). For example, a regular bed generally has one surface plane that is substantially perpendicular to the vertical direction, and that includes a lateral axis and a longitudinal axis. In contrast, an articulating bed may have a plurality of surface planes, generally one for each section. For example, a head section has a surface plane that substantially encompasses the upper surface of the head section of the mattress (again neglecting small variations due to tufting, quilting, wrinkles, folds, or irregularities in the mattress or the bedding on the mattress). As the head section rotates about an axis of rotation, the upper surface of the head section—and thus the surface plane of the head section—likewise rotates. Thus, as the bed articulates, the plurality of surface planes of an articulating bed do not all necessarily remain substantially perpendicular to the vertical direction (though some may), and neither do they necessarily remain coplanar with each other (though some may).

The term "lateral angle" means an angle determined in a lateral plane. Thus, a lateral angle is an angle as viewed in a lateral direction, meaning from a side of a bed. In the present disclosure, lateral angles are discussed with respect to a portion of a bed handle and an upper surface of a mattress.

The term "external lateral angle" means a lateral angle on the outside of a bed handle. The term "internal lateral angle" means a lateral angle on the inside of a bed handle. Further, the term "external lateral angle" refers to angles above a surface plane of a mattress.

The terms "forward side," "forward location," and "headboard side" mean a side or location next to a bed handle towards the head of a bed in a longitudinal direction. The terms "aft side," "aft location," and "footboard side" mean a side or location next to a bed handle towards the foot of a bed in a longitudinal direction. The term "forward" means in a longitudinal direction towards the head of the bed. The term "aft" means in a longitudinal direction towards the foot of the bed.

Entrapment is a condition in which a part of a person's body, such as a person's head, neck, or limb, gets stuck in a bed handle, or between a bed handle and a part of a bed, such as a mattress. Entrapment presents a serious problem to caregivers and their patients because it can lead to serious injury or death.

Various areas of potential entrapment include between a bed handle and a mattress in a lateral direction, between a bed handle and a mattress in a longitudinal direction, between a bed handle and a mattress in a vertical direction, between a bed handle and a headboard of the bed, or within parts of a bed handle itself. The embodiments disclosed herein are intended to avoid entrapment in these areas of potential entrapment for any position of the bed, whether articulated or nonarticulated.

In the lateral direction, entrapment can occur if there is a gap between a bed handle and a mattress, or if the mattress is not snug enough against the bed handle, such that a person's head or limb could slip between the mattress and the bed handle.

In the vertical direction, entrapment can occur if there is a gap between a bed handle and a mattress, or if the mattress is not snug enough against the bed handle, such that a person's head or limb could slip underneath the bed handle and get stuck between the bed handle and the mattress.

Within parts of a bed handle, entrapment may occur if a person's head or limb slips between components of the bed handle. The embodiments disclosed herein avoid this type of entrapment, for example because openings within the bed handles are limited in size to prevent a person's head from passing through an opening.

In the longitudinal direction, entrapment can occur if there is a gap between a bed handle and a mattress, such that a person's head, neck, or limb could become caught between the bed handle and the mattress. This might occur when there is a gap at the end of the bed handle between the bed handle and the mattress. Such a gap might be a space between the mattress and a part of the bed handle that is parallel to and higher than the mattress. Alternatively, such a gap might be formed by the presence of an acute external lateral angle between a part of the bed handle and a surface of the mattress, including an upper surface of the mattress.

On articulating beds, the problem of potential entrapment resulting from the formation of an acute external lateral angle between a part of a bed handle and an upper surface of a mattress is particularly pronounced. Articulation of the bed changes the slope of a section of the mattress relative to another section of the mattress. While the angle between the two sections of the mattress ordinarily will remain obtuse (possibly extending to a near-right angle), there is a risk that an external lateral angle between a part of a bed handle and an upper surface of a section of the mattress will become acute and present a risk of entrapping a user's head, neck, or limb. Some of the embodiments disclosed herein are intended to prevent the possibility of any such acute external lateral angles from forming and creating these entrapment risks.

The formation of an acute external lateral angle between a part of the bed handle and an upper surface of the mattress can create potential entrapment scenarios when the bed handle is mounted on an articulating section of the articulating bed (as opposed to being mounted on a nonarticulating section of the articulating bed). In this scenario, a user of the bed could become entrapped between the bed handle and the mattress in a position below the bed handle. For example, a user's neck could become wedged underneath the bed handle, between the mattress and the bed handle. Some of the embodiments disclosed herein are intended to prevent the possibility of acute external lateral angles from forming on at least one longitudinal side of the bed handle, thus mitigating this entrapment scenario.

Some embodiments disclosed herein may be used as mobility assistance devices in long-term care facilities, including hospitals and care centers. Mobility assistance devices may include bed rails and bed handles. Some embodiments disclosed herein may be used in private residences to support individuals with long-term or short-term care needs. The disclosed mobility assistance devices may provide a number of benefits for a user, such as care of a patient. For example, the embodiments disclosed herein may assist care patients or other users of a bed with mobility into, onto, on, off of, or around the bed. The user may grip an embodiment and exert a force—whether pulling or pushing—on the mobility assistance device in order to reposition oneself on the bed or to move onto, off of, or around the bed. The mobility assistance device may prevent a user of a bed from rolling and falling off of the bed. Additional benefits of the disclosed mobility assistance devices include hanging personal bags or placing personal items, such as mobile devices, on the mobility assistance device to be within a user's reach for easy access.

Figure 1A:
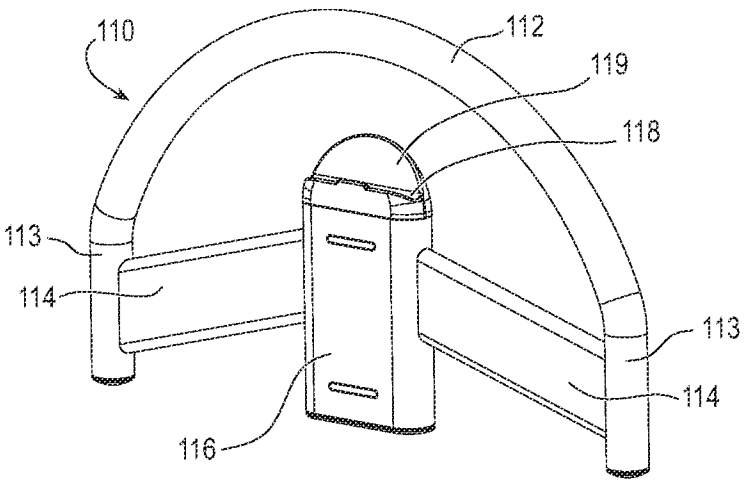
FIG. 1A is a perspective view of an embodiment of a bed handle.

FIG. 1A depicts a perspective view of a bed handle 110 of a mobility assistance device according to one embodiment of the present disclosure. A gripping member 112 may span a length of the bed handle 110 (in the longitudinal direction when the bed handle 110 is coupled to a bed), and may be suitable for gripping by a user of the mobility assistance device. The gripping member 112 may take the shape of an arc across all or nearly all of its span, as in FIG. 1A.

As shown in FIG. 1A, the gripping member 112 may be coupled to one or more support members 114. In the illustrated embodiment, the gripping member 112 is attached to two support members 114: one on either end of the span of the gripping member 112. In some embodiments, such as that shown in FIG. 1A, the gripping member 112 may be attached to only two support members 114 on either end of its span, with no additional support members attached along the span intermediate of the two support members 114. This may allow a user unobstructed grip access to the gripping member 112 across the full length of the bed handle 110, with exception only for those points along the gripping member 112 that are blocked by the mattress on the bed. But even when the bed is articulated, there may still be a wide range of points along the gripping member 112 that are unobstructed for gripping.

Also as illustrated in FIG. 1A, the one or more support members 114 may be attached to a stem 116 of the bed handle 110. The stem 116 may comprise a slot 118 and a lip 119 that can support the placement of a personal item, such as a mobile device or a handbag. The slot 118 may be a notch. The stem 116 may comprise a connection point for coupling the bed handle 110 to a base portion of the mobility assistance device.

In some embodiments, the gripping member may be attached to support members at points offset from the ends of the span of the gripping member. In some embodiments, the gripping member may be supported by two outermost support members, and additionally by one or more intermediate support members that are in between the outermost support members and that interrupt a user's grip on the gripping member at certain locations along the span of the gripping member. In other words, there may be more than two support members, including interior ribs, which connect the gripping member to the stem of the bed handle. In some embodiments, the gripping member may be supported by a single support member attached to the gripping member.

In some embodiments, including the embodiment shown in FIG. 1A, the aft and forward ends of the gripping member 112 may comprise a vertical portion 113 at which the gripping member 112 couples to the support members 114. The vertical portions 113 of the gripping member 112 may have a predetermined height that does not exceed the height of an upper surface of a mattress when the bed handle 110 is installed on a bed. Accordingly, the gripping member 112 may transition from the vertical portion 113 to a curve or another substantially arcuate shape before it passes above the surface plane of the upper surface of the mattress.

The bed handle 110 may be sized to be used with a particular thickness or range of thicknesses of mattress. For example, a first bed handle 110 may have a length and a height suitable for use with an eight-inch-thick mattress, while a second bed handle 110 may have a length and a height suitable for use with a twelve-inch-thick mattress.

As an alternative to the shape of the gripping member 112 illustrated in FIG. 1A, the gripping member may have another shape and need not be a circular arc, nor even a differentiable arc. For example, the gripping member may take a shape that approximates an arc, such as a partial polygon with many sides. Each of these possible shapes are substantially arcuate. The term "substantially arcuate" also includes shapes that approximate arcs along at least a part of the gripping member, if not the full span of the gripping member. Thus, the term "substantially arcuate" includes shapes that approximate an arc at an end of the gripping member, even while not necessarily approximating an arc along other segments of the gripping member. A gripping member might have a shape approximating an arc at only a segment of the gripping member that will abut a mattress's upper surface through a range of articulated positions, but such a gripping member is still considered substantially arcuate for this disclosure. Some embodiments of bed handles disclosed herein have gripping members with a substantially arcuate shape on one longitudinal end, while the opposite longitudinal end of the gripping member—or another structure on the opposite longitudinal end of the bed handle that is coupled to the gripping member—may be substantially rectangular or comprise some other shape. Examples of substantially arcuate shapes for a gripping member include arcs across the full span, curves on the ends joined by a straight line, compound curves, trapezoidal segments, and other polygonal segments. A gripping member of substantially arcuate shape may be unobstructed for gripping across the span by any ribs or support members, or it may be attached to intermediate support members at various points along the span.

FIG. 1B depicts a perspective view of a bed handle 110' of a mobility assistance device according to another embodiment of the present disclosure. The bed handle 110' resembles the bed handle 110 described above in certain respects. Accordingly, like features are designated with like reference numerals, with a prime symbol added. For example, the embodiment depicted in FIG. 1B includes a gripping member 112' that may, in some respects, resemble the gripping member 112 of FIG. 1A. Relevant disclosure set forth above regarding similarly identified features thus might not be repeated hereafter. Moreover, specific features of the bed handle 110' and related components shown in FIG. 1B might not be shown or identified by a reference numeral in the drawings or specifically discussed in the written description that follows. However, such features may clearly be the same, or substantially the same, as features depicted in other embodiments and/or described with respect to such embodiments. Accordingly, the relevant descriptions of such features apply equally to the features of the bed handle 110' and related components depicted in FIG. 1B. Any suitable combination of the features, and variations of the same, described with respect to the bed handle 110 and related components illustrated in FIG. 1A can be employed with the bed handle 110' and related components of FIG. 1B, and vice versa. This pattern of disclosure applies equally to further embodiments depicted in subsequent figures and described hereafter, wherein further prime symbols, such as the double prime symbol, may be appended to the reference numeral, e.g., the bed handle 110" of FIG. 1C.

In the illustrated embodiment of FIG. 1B, the gripping member 112' comprises curved segments at each end of the gripping member 112', with a straight-line segment 115' in the middle. In some embodiments, the gripping member may comprise at least one curved section, such as an arc, and at least one straight section. For example, the gripping member may be straight in the middle and curved on either end of its span. In some embodiments, the gripping member may comprise a single curved section on the aft end of the bed handle and a vertical section on the forward end of the bed handle.

In some embodiments, the gripping member may comprise compound curves. For example, the gripping member may have a first arc with a first radius at one end, transition to a second arc with a second radius in a midsection, and transition to a third arc with a third radius at the other end. The first and third radii may be of equal value or of different values. In some embodiments, the compound curve may comprise a plurality of curves with varying radii of curvature.

The gripping member 112' may be attached to one or more support members 114' in a fashion similar to the gripping member 112. The aft and forward ends of the gripping member 112' may each comprise a vertical portion 113' at which the gripping member 112' couples to the support members 114'. The one or more support members 114' may be attached to a stem 116' of the bed handle 110'. The stem 116' may comprise a connection point for coupling the bed handle 110' to a base portion of the mobility assistance device.

When coupled to an articulating bed, the gripping member 112' may be disposed over an axis of rotation of an articulating section of a bed. The curved sections of the gripping member 112' may extend in either longitudinal direction from above the axis of rotation.

Figure 1C:
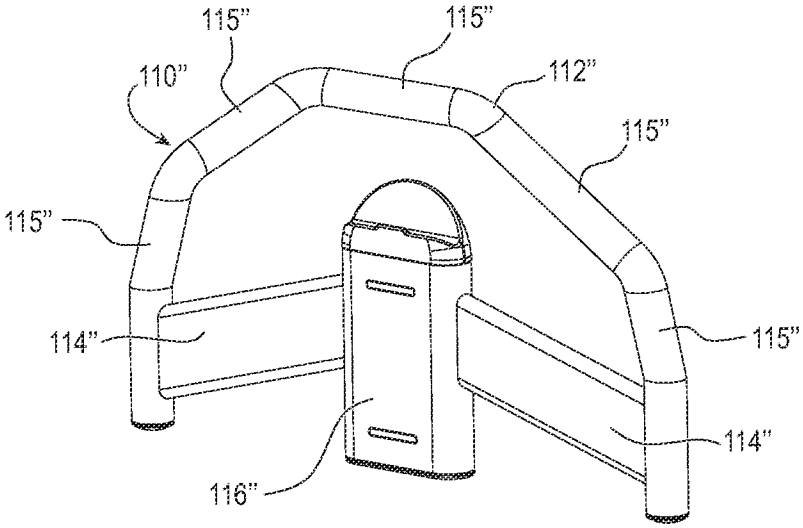
FIG. 1C is a perspective view of an embodiment of a bed handle.

FIG. 1C depicts a perspective view of a bed handle 110" of a mobility assistance device according to another embodiment of the present disclosure. In the illustrated embodiment, a gripping member 112" comprises polygonal segments 115". In some embodiments, the gripping member 112", together with support members 114" that attach the gripping member 112" to a bed handle stem 116", can form a polygon. For example, the gripping member and the support members may form a trapezoid. For another example, the gripping member 112" and the support members 114" may form a concave polygon, such as that shown in FIG. 1C.

In some embodiments, the gripping member can take the shape of part of a polygon independent of the shape of the support members. For example, the gripping member may take the shape of part of a regular hexagon. As another example, the gripping member may take the shape of part of a regular octagon. As another example, the gripping member may take the shape of a many-sided polygon that approximates an arc, as in the gripping member 112" shown in FIG. 1C.

Figure 2A:
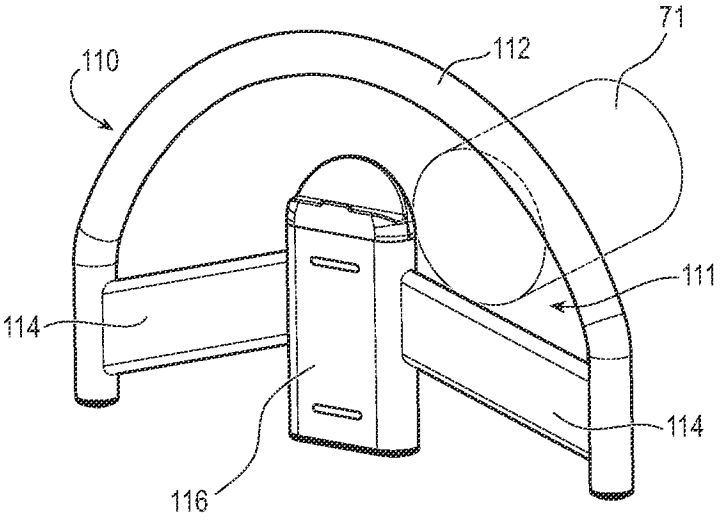
FIG. 2A is a perspective view of the bed handle of FIG. 1A restricting passage of a 120-mm-diameter cylinder through an opening of the bed handle.
Figure 2B:
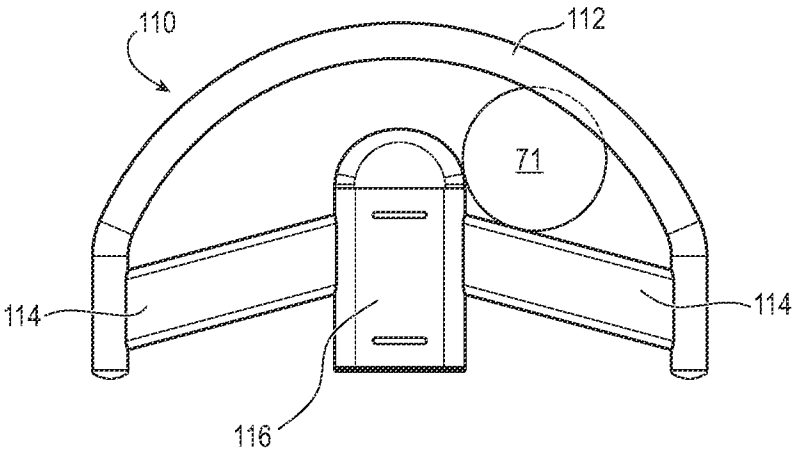
FIG. 2B is a side view of the bed handle of FIG. 1A restricting passage of a 120-mm-diameter cylinder through an opening of the bed handle.

FIG. 2A depicts a perspective view, and FIG. 2B depicts a side view, of the bed handle 110. The bed handle 110 is blocking a 120-millimeter-diameter cylinder 71 from passing through an internal opening 111 of the bed handle 110. More specifically, there is no gap between the gripping member 112 and the stem 116 or one of the support members 114 of the bed handle 110 that would allow the 120-millimeter-diameter cylinder 71 to pass through the internal opening 111 of the bed handle 110. By constructing the bed handle 110 in this way, such that its openings do not permit passage of a 120-millimeter-diameter cylinder, a risk of entrapment between members of the bed handle 110 may be reduced or eliminated. Thus, internal entrapment may be prevented—independent of whether an articulating bed on which the bed handle 110 is installed is adjusted to an articulated state—by making the bed handle 110 with openings that do not allow a 120-millimeter-diameter cylinder to pass through.

Figure 3:
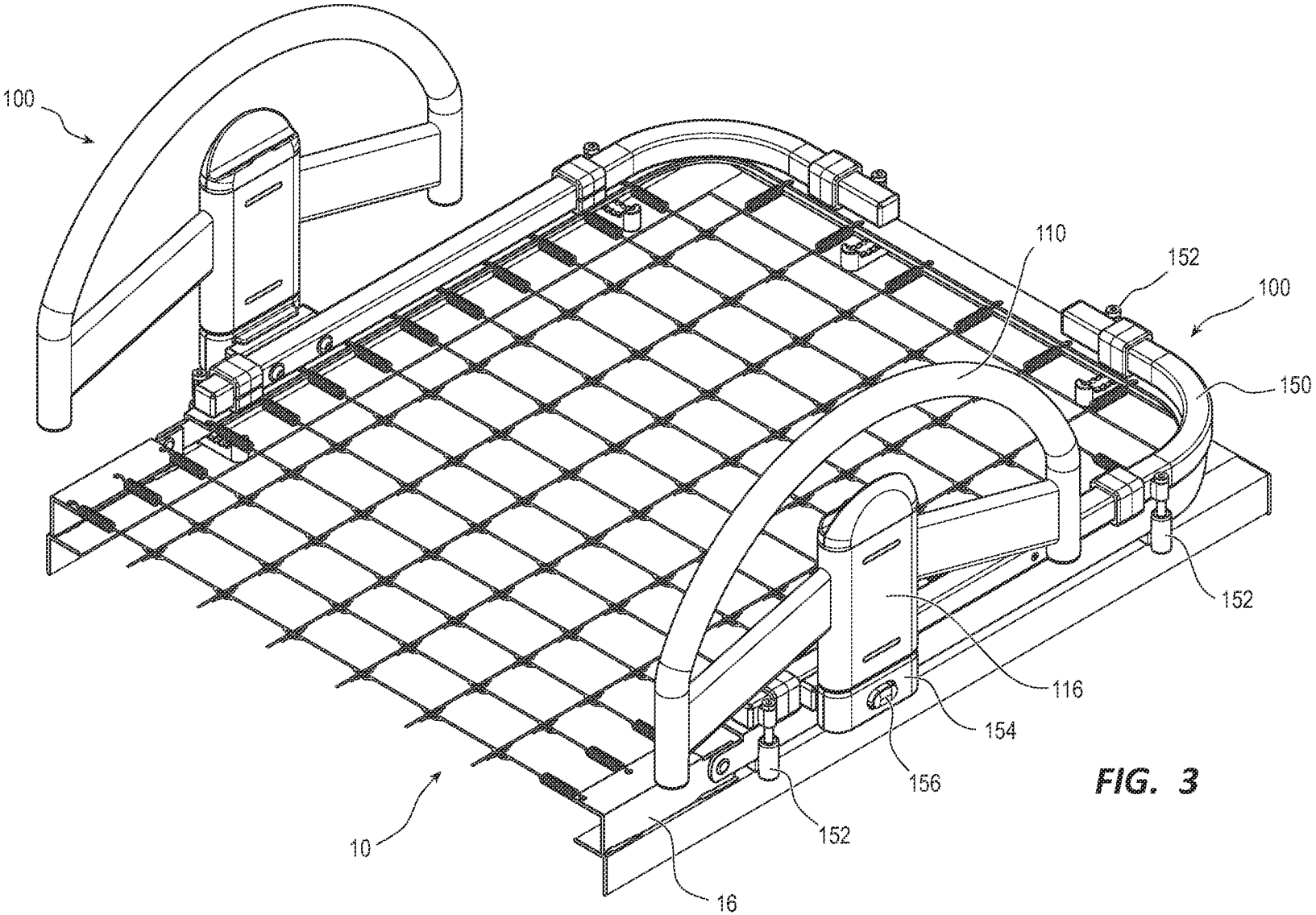
FIG. 3 is a perspective view of a first and a second bed handle according to FIG. 1A, coupled to a bed frame through a first and a second base portion, respectively.

FIG. 3 depicts a perspective view of a pair of bed handles 110, coupled respectively to a pair of base portions 150 to constitute a pair of mobility assistance devices 100 coupled to a bed frame 16 of a bed 10. The bed 10 can be a regular bed or an articulating bed. A first mobility assistance device 100 is positioned on a right side of the bed 10, and a second mobility assistance device 100 is positioned on a left side of the bed 10. Additional mobility assistance devices may be coupled to the bed, including a third mobility assistance device on the right side of the bed 10 aft of the first mobility assistance device 100, and a fourth mobility assistance device on the left side of the bed 10 aft of the second mobility assistance device 100. Alternatively, a single mobility assistance device 100 may be used by coupling a single bed handle 110 to one side of the bed 10. This may be useful, for example, when an opposite side of the bed 10 is obstructed, such as when placed against a wall.

The embodiment shown in FIG. 3 includes a base portion 150 coupled to the bed frame 16 at three coupling points 152. The coupling at coupling points 152 may be accomplished with clamps, wherein fastening hardware such as screws or bolts connect the clamps to the base portion 150. The fastening hardware may pass through loops or holes in the base portion 150 and thread into the clamps. Tightening of the fastening hardware may cause jaws of the clamps to tighten around a portion of the bed frame 16, such as a perimeter of the bed frame 16. This may secure the base portion 150 to the bed frame 16. In some embodiments, fewer than three coupling points may be present on the base portion, including one or two coupling points. In other embodiments, more than three coupling points may be present on the base portion, including four, five, or more coupling points.

The base portion 150 may be "L" shaped. An "L" shape allows clamps to be tightened around the bed frame 16 on both a side of the bed frame 16 and an end of the bed frame 16, as depicted in FIG. 3. This may provide additional stability to the mobility assistance device 100 over what would be achieved with a simpler straight-line base portion. The corner of the "L" shape of the base portion 150 may be rounded. With or without rounded corners, such base portions are essentially L-shaped.

The base portion 150 may be mirror symmetric about a plane that contains both segments of the "L" shape (a plane that is horizontal when the base portion 150 is coupled to a bed in a nonarticulated state, as in FIG. 3). This symmetry may give the advantage that the base portion 150 may be coupleable to any side of the bed 10. For example, the base portions 150 of the mobility assistance devices 100 shown in FIG. 3 may both be identical units, and may be perfectly interchangeable.

The base portion 150 may comprise a receiver 154. The receiver 154 may be an integral part of the base portion 150, or it may be a separate component coupleable to the base portion 150. For example, the receiver 154 may be attachable to the base portion 150 with fastening hardware, such as washers and bolts or screws.

The receiver 154 may comprise a biasing member 156, such as a push button or a release button. The biasing member 156 may comprise a spring-action lever. The receiver 154 may be configured to couple with the stem 116 of the bed handle 110. In the illustrated embodiment, the bed handle 110 couples to a single receiver 154 and engages a single biasing member 156. In another embodiment, the base portion may have multiple receivers, and the bed handle may couple to the base portion at multiple points by engaging multiple biasing members. The bed handle 110 may be releasably coupleable to the receiver 154, and disengagement of the biasing member 156 may allow the bed handle 110 to be decoupled from the receiver 154.

The bed handle 110 may couple to the bed 10 solely through the receiver 154, and need not contact the floor. More particularly, in some embodiments, the base portion 150 and the bed handle 110 do not engage the floor.

The base portion 150 may be disposed under a mattress, such as between the mattress and a bed frame, a box spring, or a bed base.

Figure 4:
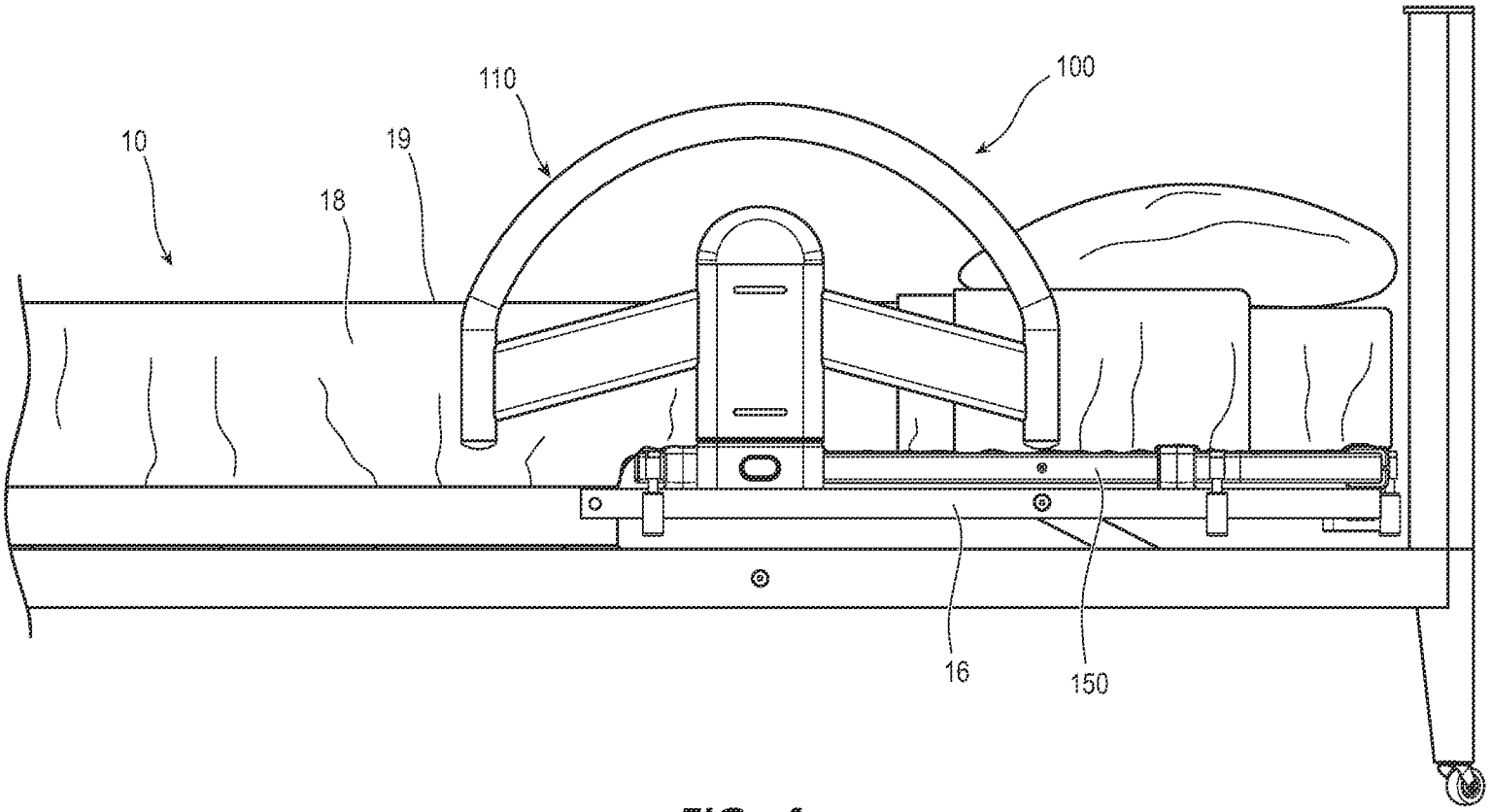
FIG. 4 is a side view of a bed handle according to FIG. 1A, coupled to a bed frame through a base portion, with the bed frame in an unarticulated state and with a mattress and bedding on the bed frame.

FIG. 4 depicts a side view of the mobility assistance device 100 coupled to the bed frame 16 of the bed 10. In the illustrated embodiment, the bed handle 110 is coupled to the base portion 150. The base portion 150 is coupled to the bed frame 16, and is disposed under a mattress 18 of the bed 10. In FIG. 4, the bed 10 is in an unarticulated state. A user may use the bed handle 110 to get into, out of, or maneuver on or around the bed 10.

The mattress 18 may be accompanied by bedding, such as sheets and a comforter or other blanket. The goal of avoiding entrapment between a bed handle and a mattress applies equally whether or not the mattress has bedding on it. Thus, in the present disclosure, for simplicity, the discussion of lateral angles between a bed handle and a mattress may be silent as to whether or not the mattress has bedding on it, but remains applicable whether or not the mattress has bedding on it. The embodiments of bed handles disclosed herein may avoid acute external lateral angles between a bed handle and an upper surface of a mattress, and they may equally avoid acute external lateral angles between the bed handle and an upper surface of a sheet, a blanket, or other bedding on the mattress.

In some embodiments, the bed handles are sized to be used with a mattress with a thickness of approximately six inches. In some embodiments, the bed handles are sized to be used with a mattress with a thickness of approximately sixteen inches. In some embodiments, the bed handles are sized to be used with a mattress with a thickness within the range between six and sixteen inches, including approximately eight inches, approximately ten inches, approximately twelve inches, or approximately fourteen inches.

Figure 5:
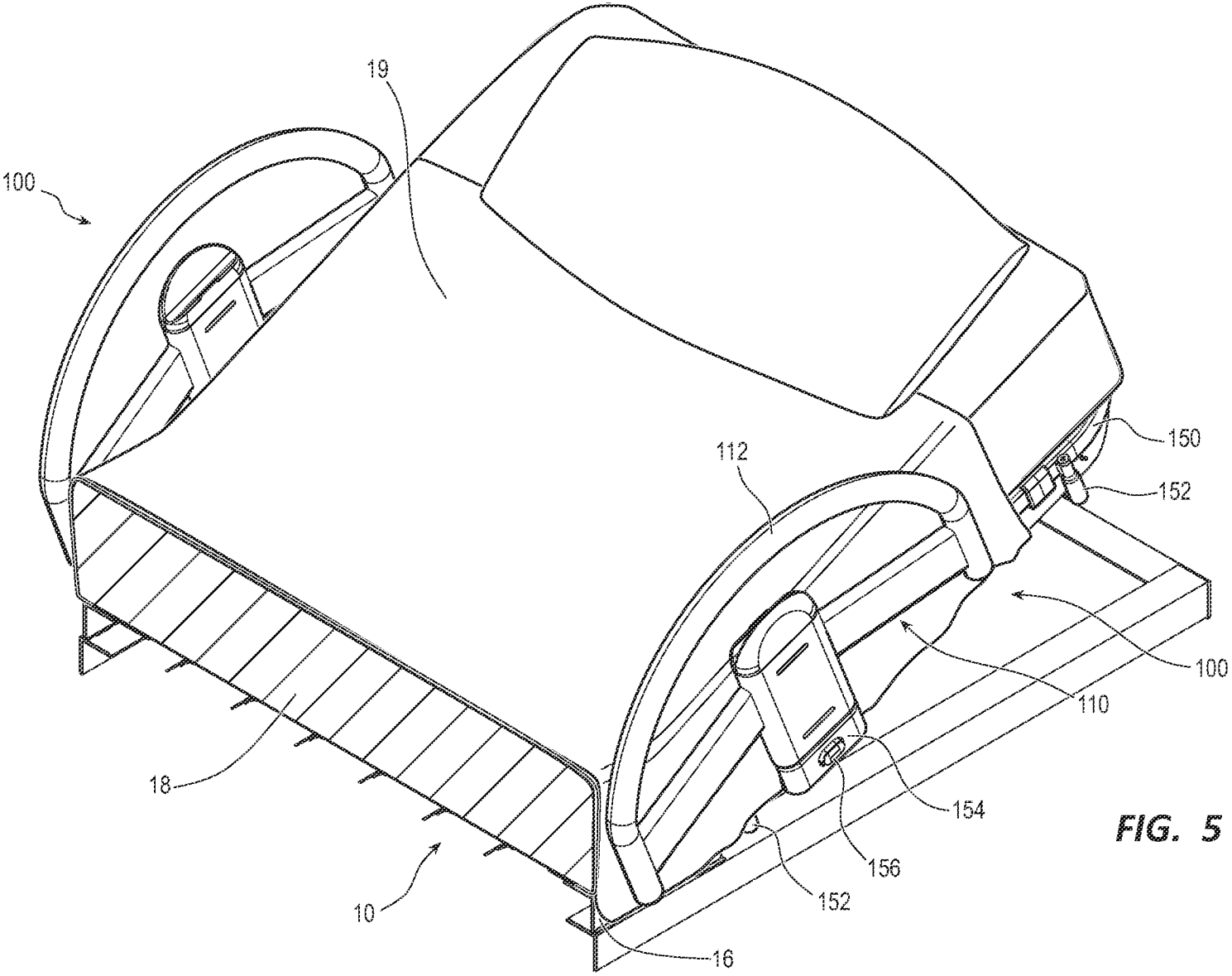
FIG. 5 is a perspective view of the bed handles of FIG. 3, with the bed frame in an articulated state and with a mattress and bedding on the bed frame.
Figure 6:
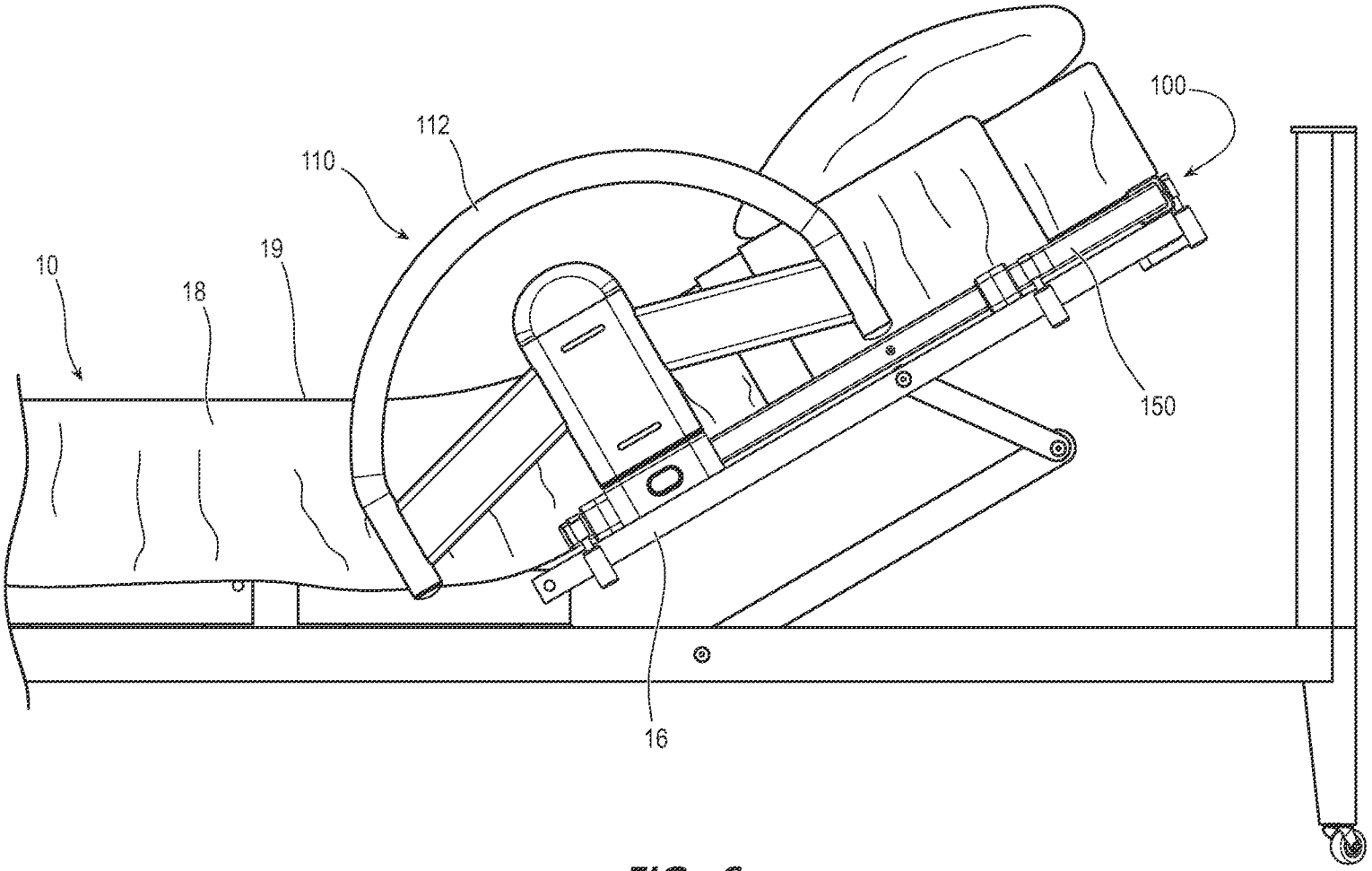
FIG. 6 is a side view of the bed and bed handle of FIG. 4, with the bed in an articulated state.

FIGS. 5 and 6 depict the bed 10 and the mobility assistance device 100 of FIG. 4, with the bed 10 in an articulated state. A second mobility assistance device 100 on an opposite side of the bed 10 is also shown in FIG. 5. The mobility assistance device 100 avoids areas of potential entrapment of a body part between the bed handle 110 and the bed 10. As to entrapment in a lateral direction, the bed handle 110 is coupled to the bed 10 such that it is snug with a mattress 18 of the bed 10 in the lateral direction. This prevents a user's head or limb from falling between the bed handle 110 and the mattress 18 and getting stuck. As to entrapment in a longitudinal direction, entrapment is prevented because the gripping member 112 of the bed handle 110 does not form an acute lateral angle with an upper surface 19 of the mattress 18 external to the bed handle 110. Acute external lateral angles between the bed handle 110 and the upper surface 19 of the mattress 18 can cause a user's head, limb, or other body part to become wedged between the bed handle 110 and the mattress 18. In contrast, right external lateral angles and obtuse external lateral angles between the bed handle 110 and the upper surface 19 of the mattress 18 prevent a user's head, limb, or other body part from becoming wedged between the bed handle 110 and the mattress 18. As the bed 10 articulates, the gripping member 112 rotates about an axis of rotation such that the spaces just forward and aft of the gripping member 112 in a longitudinal direction remain free of acute external lateral angles.

The lack of acute lateral angles between the gripping member 112 of the bed handle 110 and the upper surface 19 of the mattress 18 exists external to the bed handle 110, both forward and aft of the bed handle 110. Within the bed handle 110, there might exist an acute lateral angle between the gripping member 112 and a mattress surface. Such acute internal lateral angles do not present an entrapment problem, however, because the bed handle 110 is constructed to prevent entrapment within its own members. Specifically, as described above in connection with FIGS. 2A and 2B, a 120-millimeter-diameter cylinder is prevented from passing through the bed handle 110. Such construction may ensure that a user will not be entrapped within the inside of the bed handle 110. Therefore, the absence of acute lateral angles between the gripping member 112 and the upper surface 19 of the mattress 18 may be important on the outside of the bed handle 110, rather than the inside. Thus, some of the embodiments described herein are constructed such that external lateral angles remain obtuse or right throughout articulation of the bed 10. The embodiment illustrated in FIGS. 5 and 6 ensures that external lateral angles between the gripping member 112 and the upper surface 19 of the mattress 18 remain obtuse or right, not acute.

Figure 7:
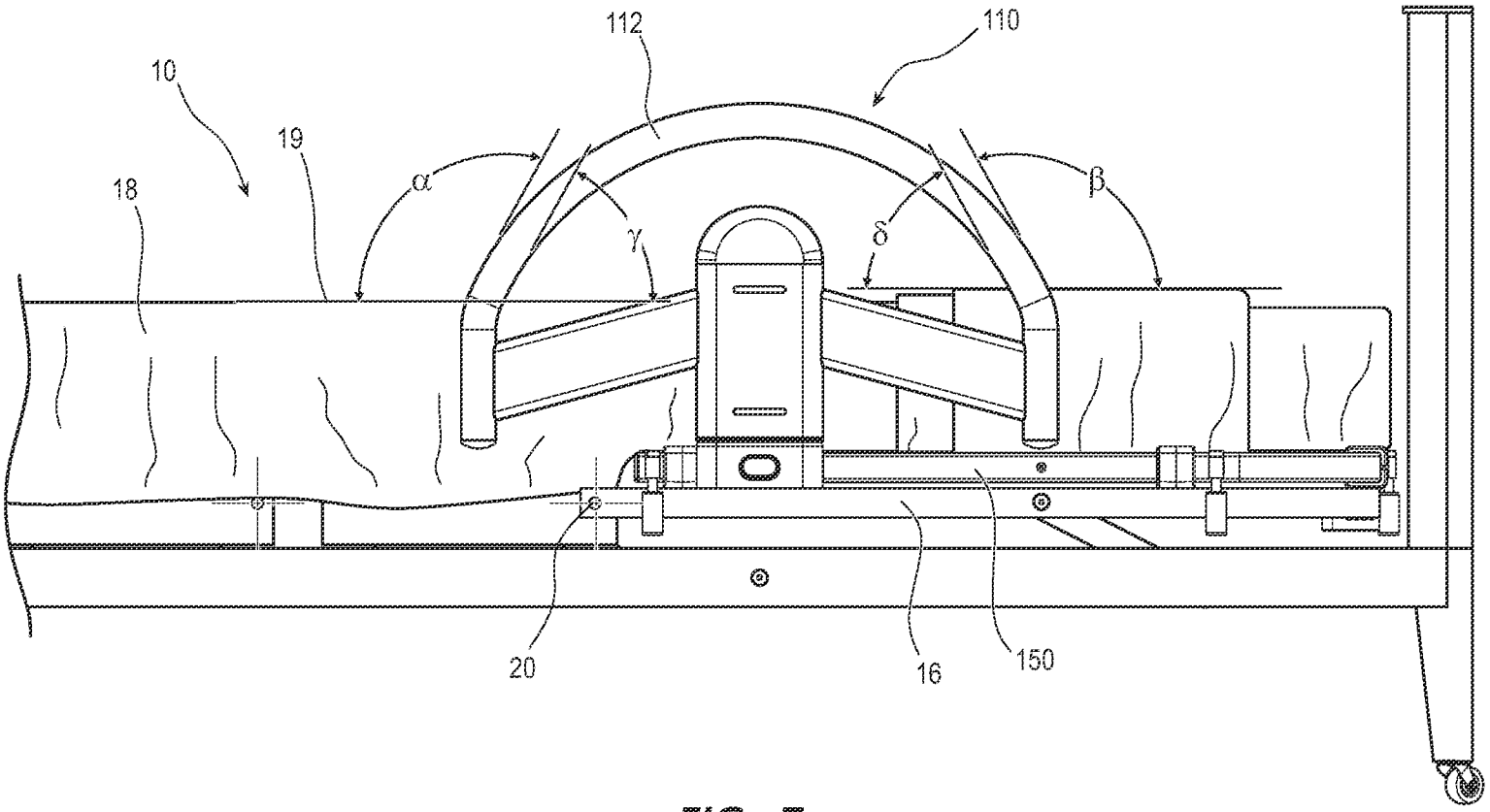
FIG. 7 is a side view of the bed and bed handle of FIG. 4, with the bed in an unarticulated state, and with lateral angles depicted.
Figure 8:
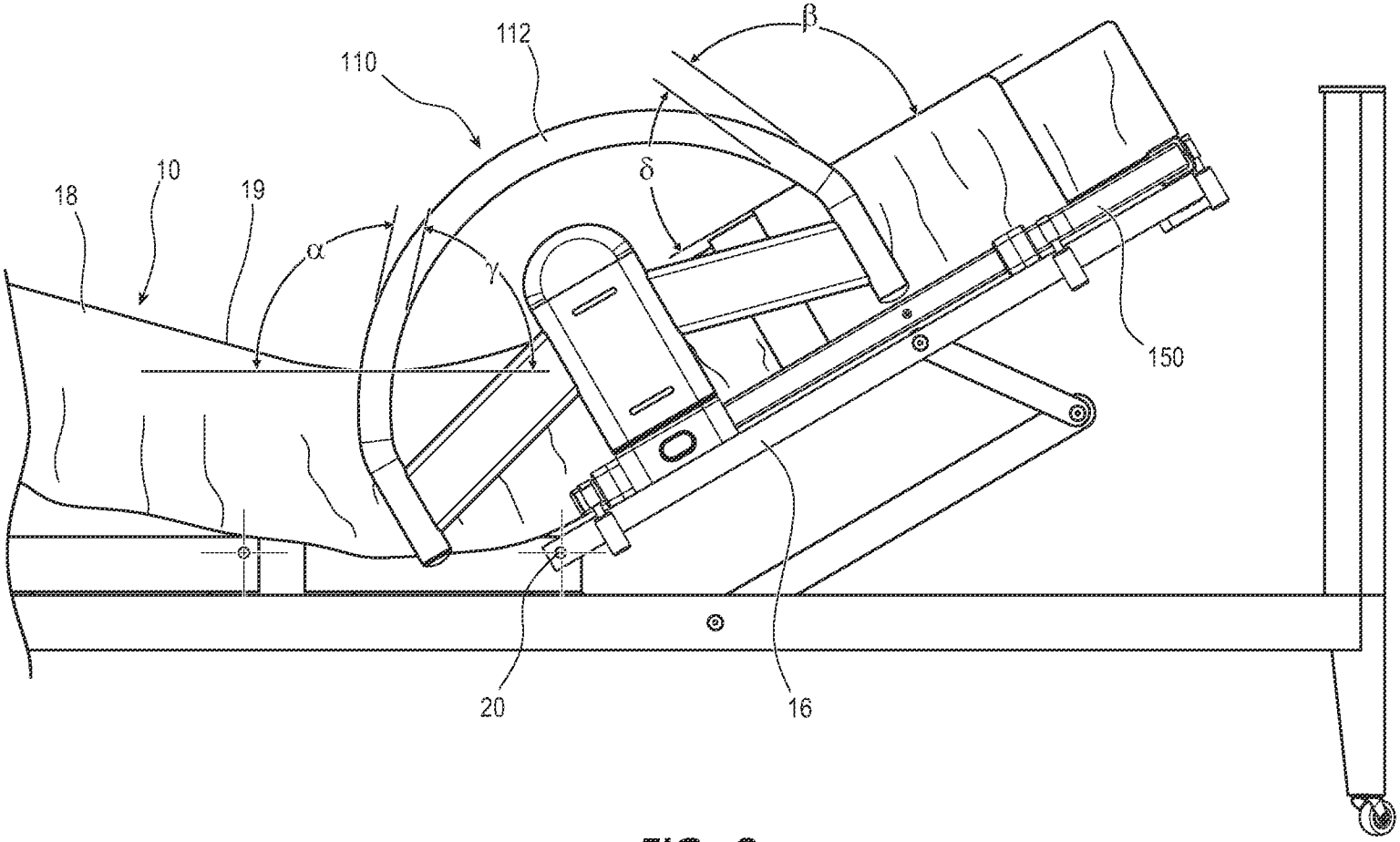
FIG. 8 is a side view of the bed and bed handle of FIG. 4, with the bed in an articulated state, and with lateral angles depicted.

FIGS. 7 and 8 illustrate the concept of lateral angles between the gripping member 112 and the upper surface 19 of the mattress 18. In FIG. 7, the bed 10 is in an unarticulated state. In FIG. 8, the bed 10 is in an articulated state. Four lateral angles are depicted in each figure: α (alpha), β (beta), γ (gamma), and δ (delta). The angles α (alpha) and β (beta) are external lateral angles on an aft side and a forward side, respectively, of the bed handle 110. The angles γ (gamma) and δ (delta) are internal lateral angles on an aft side and a forward side, respectively, of the bed handle 110. These four angles are each determined in a lateral plane, and are therefore called lateral angles. In other words, the lateral angles are angles as viewed from a side of the bed 10. The four lateral angles are further determined with respect to two lines each: a first line coincident with a surface plane substantially encompassing the upper surface 19 of the mattress 18, and a second line tangent to the gripping member 112. When the bed 10 is articulated, there are multiple surface planes with differing orientations, so the first line for each angle is determined in a surface plane that is defined by the upper surface 19 of the section of the mattress 18 adjacent to the point where the angle is determined. For each of the four lateral angles, the two lines are determined on the corresponding side of the bed handle 110 (aft or forward, and inside or outside) where the particular angle is found. Furthermore, these four angles are determined above their respective surface plane, rather than below the surface plane. Angles below the surface plane are generally not of concern because they are blocked by the mattress 18 and do not pose a risk of entrapment to a user.

Stated differently, on the aft side of the bed handle 110, the angle α (alpha) is determined between a first line coincident with a surface plane defined by the upper surface 19 of an aft-side section of the bed 10 (the section abutting the gripping member 112 on the aft side of the bed handle 110) and a second line tangent to the gripping member 112 at the outside point where the gripping member 112 intersects the surface plane of the aft-side section. Next, the angle γ (gamma) is determined the same way as the angle α (alpha), only on the inside of the bed handle 110 rather than on the outside. The outside and inside lines tangent to the gripping member 112 for determining the angles α (alpha) and γ (gamma) are parallel to each other, or nearly parallel to each other (accounting for slight differences due to the thickness of the gripping member 112). The lines coincident with the surface plane for determining the angles α (alpha) and γ (gamma) are the same line, or nearly the same line (accounting for slight differences due to slight bending of the mattress 18 during articulation adjacent to the gripping member 112). Thus, neglecting the thickness of the gripping member 112 and neglecting possible slight bending of the mattress 18 adjacent to the gripping member 112, the angles α (alpha) and γ (gamma) are adjacent supplementary angles.

Similarly, on the forward side of the bed handle 110, the angle β (beta) is determined between a first line coincident with a surface plane defined by the upper surface of a forward-side section of the bed 10 (the section abutting the gripping member 112 on the forward side of the bed handle 110) and a second line tangent to the gripping member 112 at the outside point where the gripping member 112 intersects the surface plane of the forward-side section. Next, the angle δ (delta) is determined the same way as the angle β (beta), only on the inside of the bed handle 110 rather than on the outside. The outside and inside lines tangent to the gripping member 112 for determining the angles β (beta) and δ (delta) are parallel to each other, or nearly parallel to each other (accounting for slight differences due to the thickness of the gripping member 112). The lines coincident with the surface plane for determining the angles β (beta) and δ (delta) are the same line, or nearly the same line (accounting for possible slight differences due to slight bending of the mattress 18 adjacent to the gripping member 112). Thus, neglecting the thickness of the gripping member 112 and neglecting possible slight bending of the mattress 18 adjacent to the gripping member 112, the angles β (beta) and δ (delta) are adjacent supplementary angles.

As shown in FIG. 7, when the bed 10 is in an unarticulated state, the first line for determining the angles α (alpha) and γ (gamma) is the same line or nearly the same line (accounting for slight variation due to folds in the bedding) as the first line for determining the angles β (beta) and δ (delta). This is because the sections of the bed 10 share the same orientation when the bed 10 is in the unarticulated state, and the surface planes of the sections of the bed 10 are coplanar.

During articulation of the bed, the lateral angles may change in value. For example, upon a change of the bed 10 from the unarticulated state as shown in FIG. 7 to an articulated state as shown in FIG. 8, the aft-side angles α (alpha) and γ (gamma) change. This change occurs because the aft-side section of the bed 10 on the aft side of an axis of rotation 20 rotates a different amount than the bed handle 110 (including, possibly, that the aft-side section does not rotate at all while the bed handle 110 does rotate, or, possibly, that the aft-side section rotates in a different rotational direction than the bed handle 110). In this way, articulation of the bed 10 causes some of the lateral angles to change.

In contrast, the forward-side angles β (beta) and δ (delta) may remain constant, as depicted in the change of state from FIG. 7 to FIG. 8, because the bed handle 110 in the depicted embodiment is coupled to an articulating section of the bed 10 on the forward side of the axis of rotation 20. Thus, in this configuration, the bed handle 110 rotates with that forward-side articulating section, and the lateral angles β (beta) and δ (delta) do not change.

The angles γ (gamma) and δ (delta) are angles inside of the bed handle 110 (internal lateral angles). These angles may be acute, but they do not present an entrapment problem because, as described above in connection with FIGS. 2A and 2B, the bed handle 110 is constructed to prevent a 120-millimeter-diameter cylinder from passing through the opening between the gripping member 112 and the support members 114 or the stem 116 of the bed handle 110. In contrast, the angles α (alpha) and β (beta) are angles outside of the bed handle (external lateral angles). These external lateral angles are sites where potential entrapment might occur if the angles become acute. As shown in FIG. 8, these outside angles remain obtuse or right, and not acute. This is true in any articulated state of the bed 10, as well as the nonarticulated state of the bed 10. In this way, while articulation of the bed 10 causes some of the lateral angles to change, articulation of the bed 10 does not cause any of the external lateral angles to become acute. Thus, the entrapment problem in forward and aft locations adjacent to the bed handle 110 is successfully avoided.

Also shown in FIGS. 7 and 8, the position of the bed handle 110 when secured to the bed 10 may be such that the bed handle 110 is above an axis of rotation 20 of an articulating section of the bed 10. Part of the bed handle 110 may be disposed on a forward side or headboard side of the axis of rotation 20, and part of the bed handle 110 may be disposed on an aft side or footboard side of the axis of rotation 20. Positioning the bed handle 110 above the axis of rotation 20 may allow for the gripping member 112 to maintain an obtuse external lateral angle with the upper surface 19 of the mattress 18 throughout articulation of the bed 10. Thus, the angles $\alpha$ (alpha) and $\beta$ (beta) remain obtuse.

Figure 9:
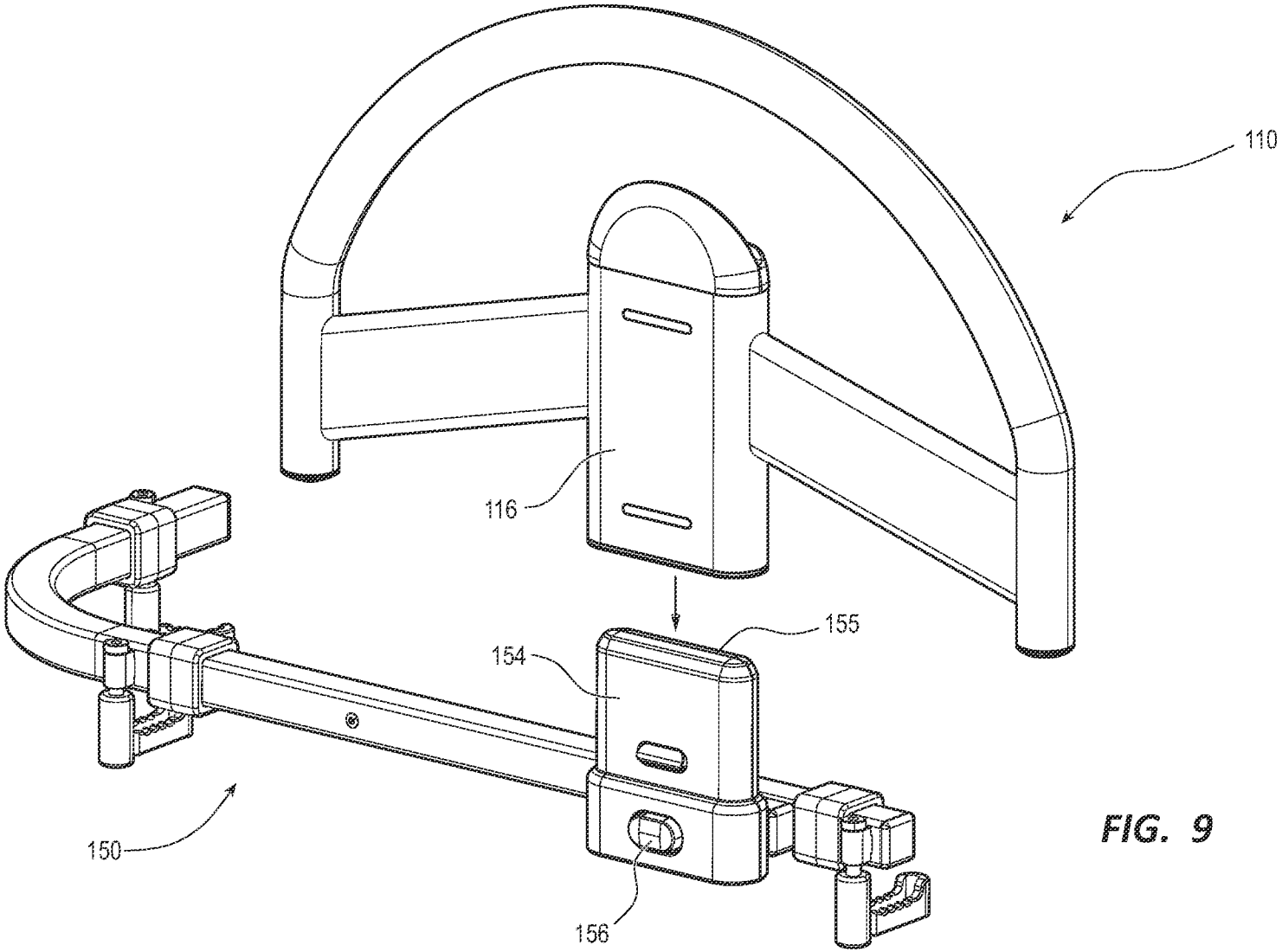
FIG. 9 is a perspective view of the bed handle of FIG. 1A ready to be coupled to a receiver and base portion.

FIG. 9 depicts a perspective view of the bed handle 110 ready to be coupled to the receiver 154 and the base portion 150. In some embodiments, the receiver 154 has a tapered edge at a top surface 155 where the bed handle 110 first contacts the receiver 154 during coupling. In some embodiments, the edge of the top surface 155 of the receiver 154 can be rounded. One benefit of a tapered or rounded edge on the receiver 154 is easier coupling with the bed handle 110. Another benefit of a tapered or rounded edge on the receiver 154 is safety of the bed's user when the bed handle 110 is removed from the receiver 154 and not in use. Such safety can be gained from avoiding sharp corners on the top surface 155 of the receiver 154.

In some embodiments, the receiver 154 has a wide rectangular cross section. The wide dimension of the rectangular cross section may be along the longitudinal direction of a bed 10, and the narrow dimension may be along the lateral direction of the bed 10. The wide rectangular cross section can provide stability to the bed handle 110 that aids a user with gripping and pushing or pulling while moving positions on the bed 10. For example, the wide rectangular cross section may help prevent rotation of the bed handle 110 around a vertical axis relative to the receiver 154. The wide rectangular cross section may include tapered edges or rounded edges, including up to a full slotted shape, as can be seen on the receiver 154 in FIG. 9.

The bed handle 110 can be coupled to the receiver 154 by sliding the bed handle 110 onto the receiver 154. In some embodiments, this can be done without manually engaging the biasing member 156. For example, in some embodiments, the biasing member 156 on the receiver 154 comprises a levered latch that is pushed aside by the stem 116 of the bed handle 110 while the bed handle 110 is slid onto the receiver 154. Upon full coupling to the receiver 154, the bed handle 110 may engage the biasing member 156.

In some embodiments, the receiver might not have a biasing member, and coupling of the bed handle 110 to the receiver may be accomplished merely by sliding or pressing the bed handle 110 onto the receiver. In such embodiments, the bed handle 110 may be secured to the receiver because of a close tolerance, such as a similar fit or a locational clearance fit.

Figure 10:
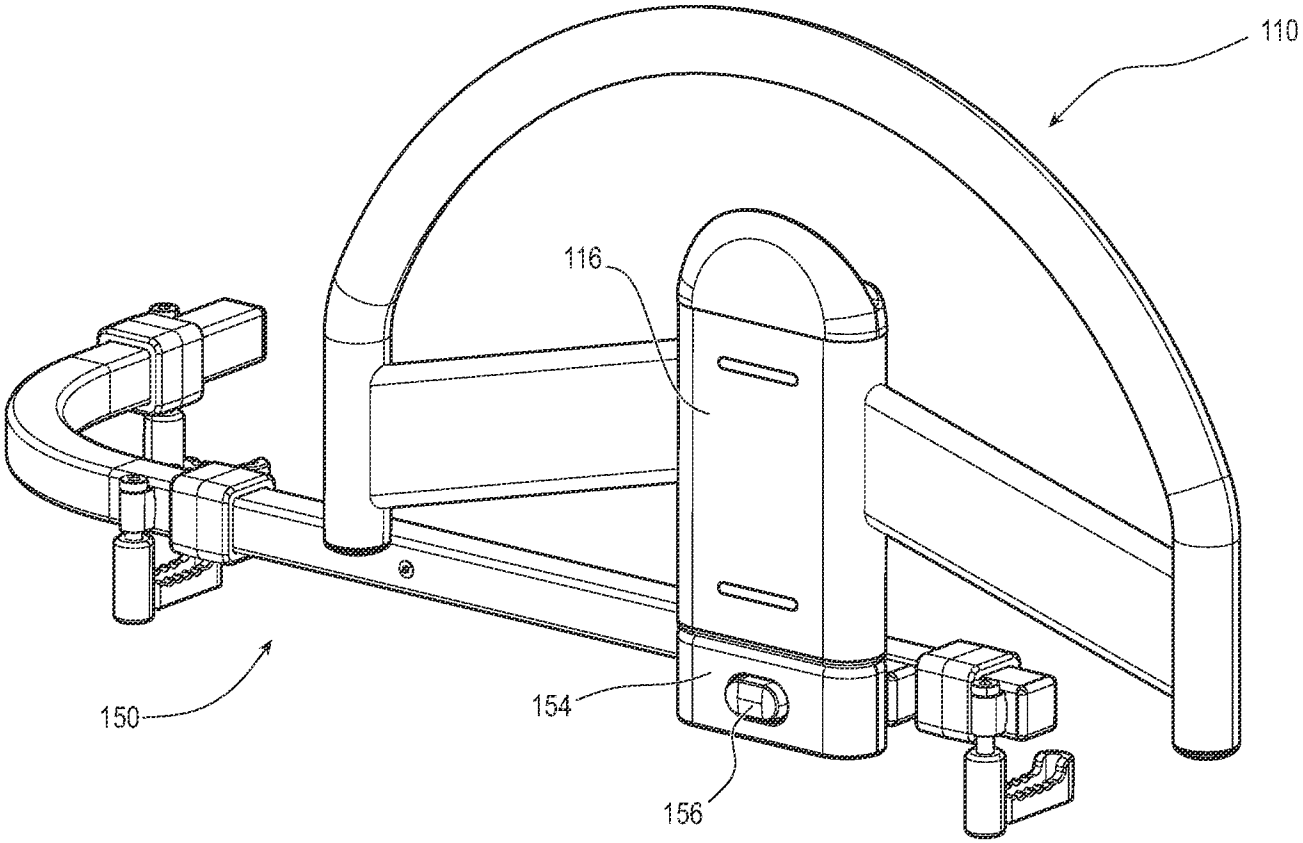
FIG. 10 is a perspective view of the bed handle of FIG. 1A coupled to a receiver and base portion.

FIG. 10 depicts a perspective view of the bed handle 110 coupled to the receiver 154 and the base portion 150. In the depicted embodiment, the bed handle 110 engages with the biasing member 156 upon full coupling. The bed handle 110 is then securely coupled to the receiver 154. The bed handle 110 can be released and decoupled from the receiver 154 by disengaging the biasing member 156, such as pressing a release button, and sliding the bed handle 110 upward off of the receiver 154.

Figure 11:
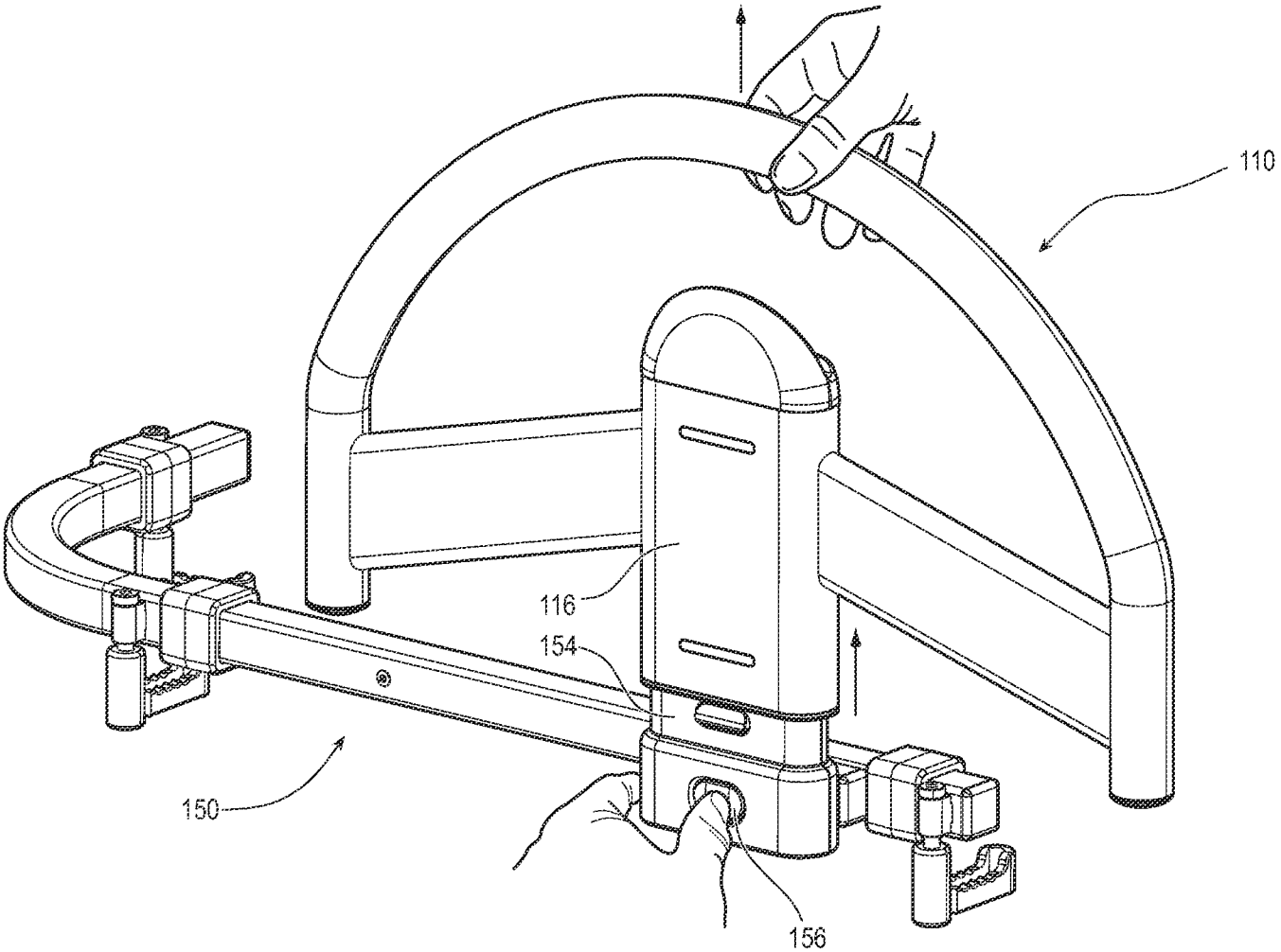
FIG. 11 is a perspective view of a user disengaging a biasing member and decoupling the bed handle of FIG. 1A from a receiver and base portion.

FIG. 11 depicts a perspective view of a user pressing a release button to disengage the biasing member 156 and decouple the bed handle 110 from the receiver 154. In some embodiments, the bed handle 110 is coupled to a bed frame by a single receiver 154, and decoupling can be achieved by pressing a single release button with one hand and lifting the bed handle 110 upwards with the other hand to slide the bed handle 110 off of the receiver 154. This simplicity makes it possible for a single user to decouple the bed handle 110 from the receiver 154. Another benefit of coupling the bed handle 110 to the bed through a single receiver 154 is that manufacturing costs may be less than they otherwise would be, in that tolerancing is not as stringent as it would be if there were multiple receivers.

In another embodiment of a mobility assistance device, a bed handle is coupled to a bed frame by multiple receivers.

Figure 12:
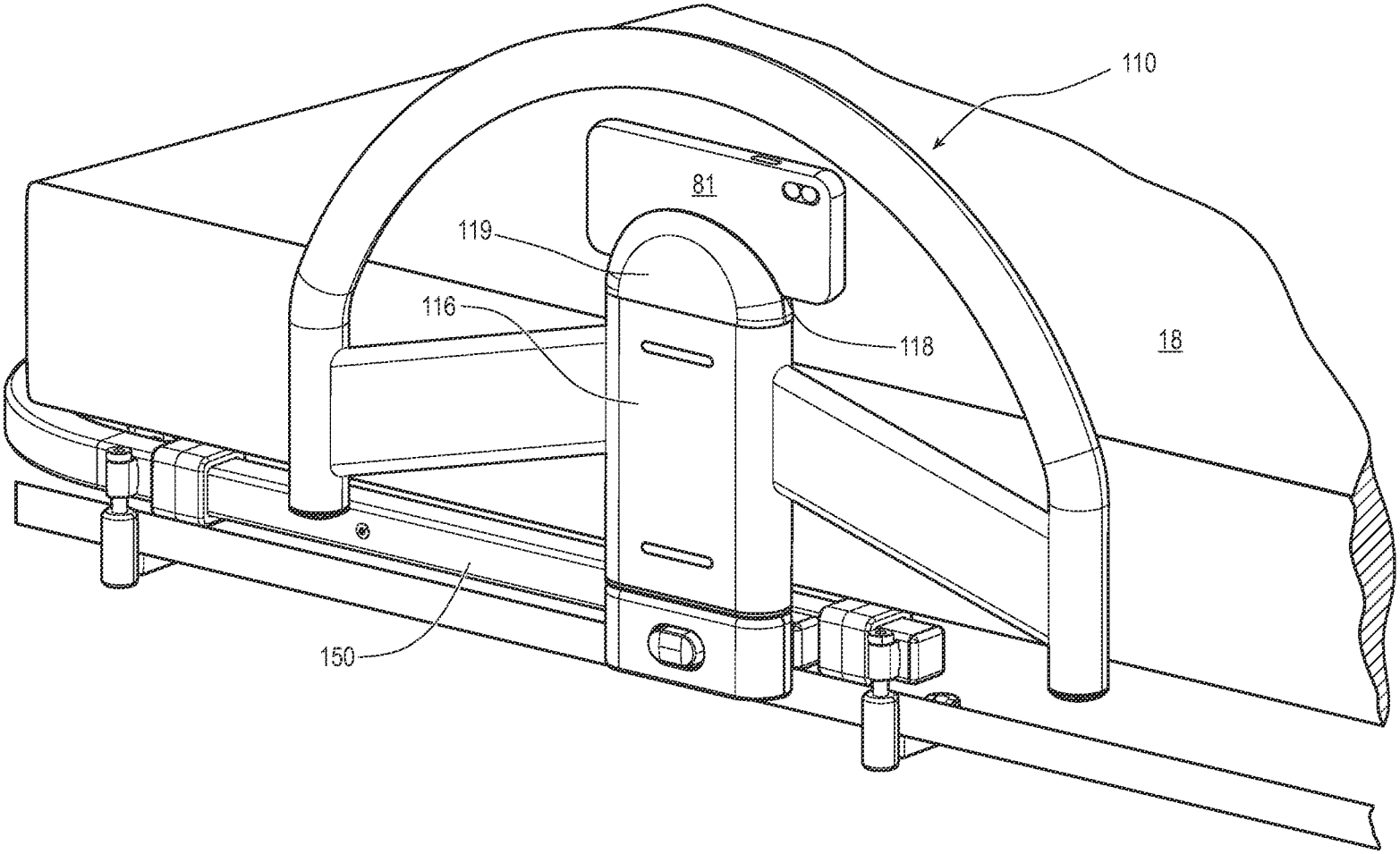
FIG. 12 is a perspective view of the bed handle of FIG. 1A supporting a mobile device.

FIG. 12 depicts a view of the bed handle 110 supporting a personal item, and more particularly, a mobile device 81. As discussed above, in some embodiments the stem 116 of the bed handle 110 may contain the slot 118 and the lip 119. The mobile device 81 or another personal item may rest on the slot 118. The lip 119 may provide a back rest to support the mobile device 81. This may provide a resting position for the mobile device 81 for convenient viewing and access by the user.

Figure 13:
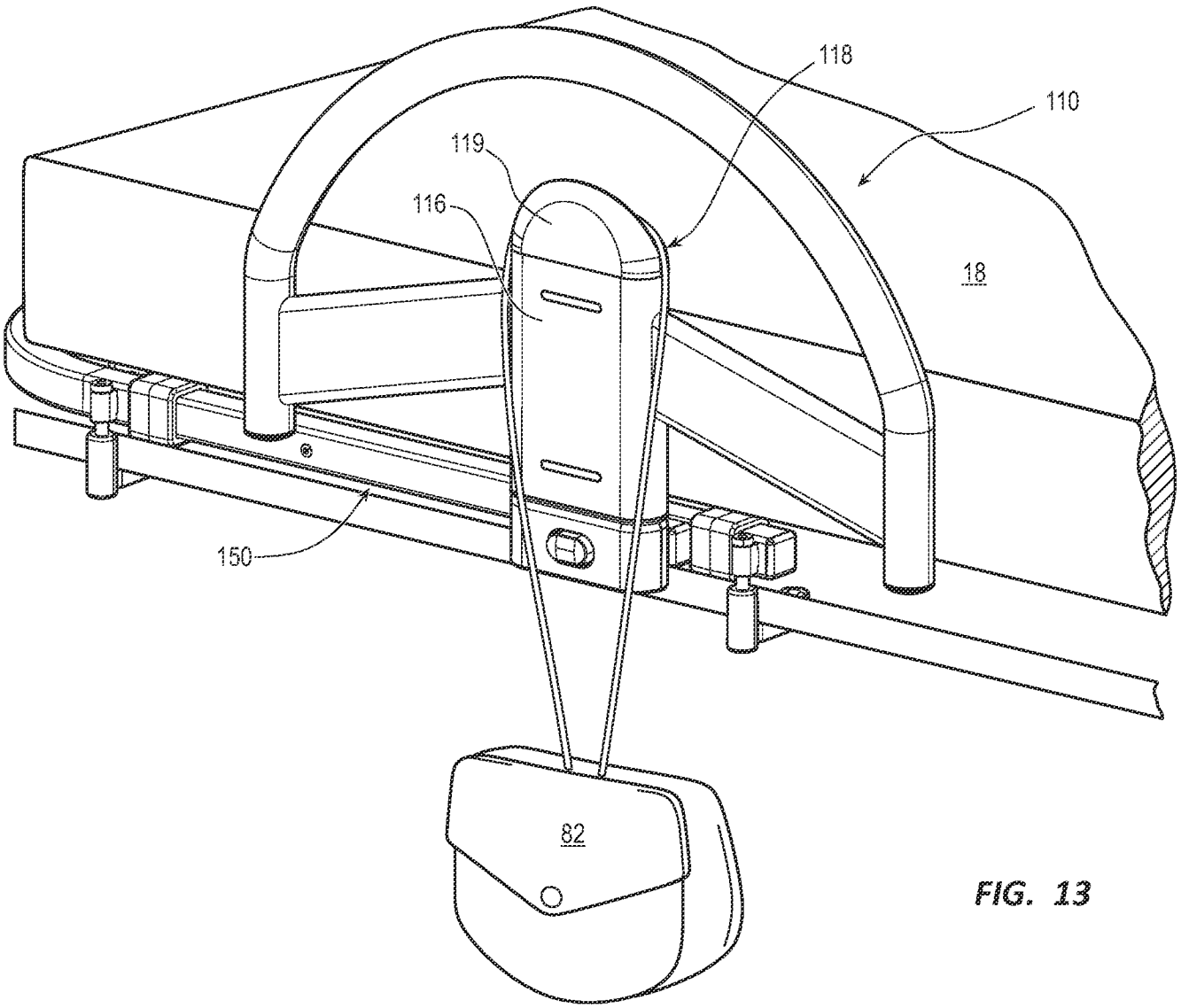
FIG. 13 is a perspective view of the bed handle of FIG. 1A supporting a handbag.

A secondary use of the bed handle 110 may be to hang a container or hanger from the bed handle 110 for a user's convenient access to personal items. FIG. 13 depicts a view of the bed handle 110 supporting a personal item, and more particularly, a purse or a handbag 82. The slot 118 and the lip 119 may provide a resting or hanging position for the handbag 82 for convenient access by the user. Alternatively, or additionally, the user may hang a container or hanger from the gripping member 112 of the bed handle 110.

Figure 14:
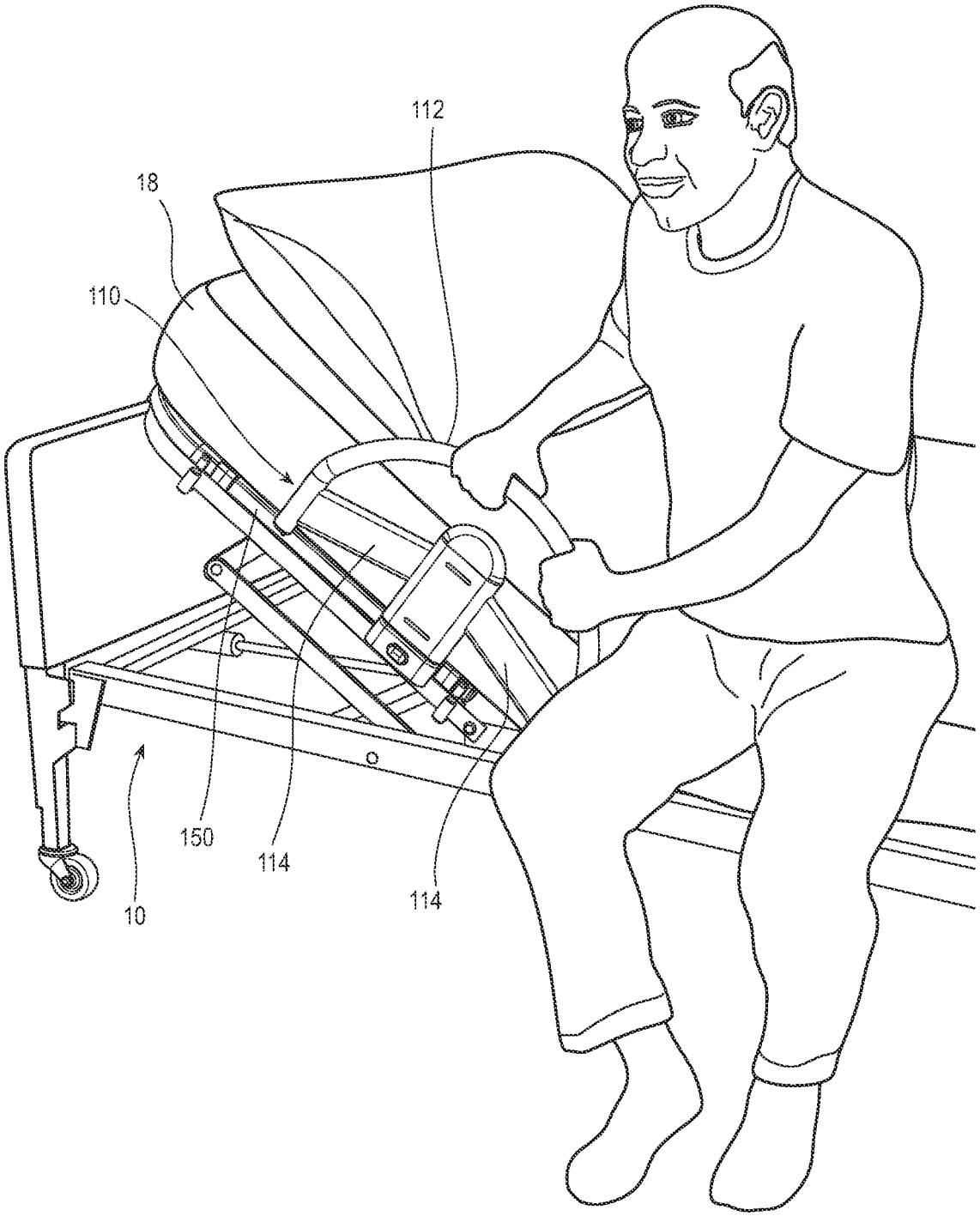
FIG. 14 is a perspective view of the bed handle of FIG. 1A coupled to a bed in an articulated state and supporting a user for mobility assistance.

FIG. 14 depicts a perspective view of the bed handle 110 coupled to a bed 10 in an articulated state and supporting a user for mobility assistance. The bed handle 110 provides a secure means for pulling or pushing oneself off of or onto the bed 10, and for repositioning oneself on the bed 10. Additionally, the bed handle 110 can protect a user from falling off of the bed 10.

FIG. 14 also depicts the gripping member 112 of the bed handle 110 with a wide range of points on the gripping member 112 for which the user's grip is unobstructed by support members 114. In some embodiments, the range of gripping points can span the length of the bed handle 110 in the longitudinal direction. In some embodiments, the range of gripping points can span a half turn of arc or nearly a half turn of arc along a substantially arcuate shape of the gripping member 112. In some embodiments, the range of gripping points is limited by the mattress 18, rather than by the support members 114. This can be seen in both FIG. 14 and FIG. 8, in which the bed 10 is in an articulated state, and the mattress 18 somewhat limits the range of gripping points on the gripping member 112. Yet even when the bed 10 is in an articulated state, there remains a wide range of points on the gripping member 112 to which a user may grip. Such unobstructed space for gripping provides the user a variety of positions by which the user can grasp the gripping member 112 and exert a pulling or pushing force. This unobstructed gripping space enhances the ergonomic benefit of the bed handle 110 to the user.

Figure 15:
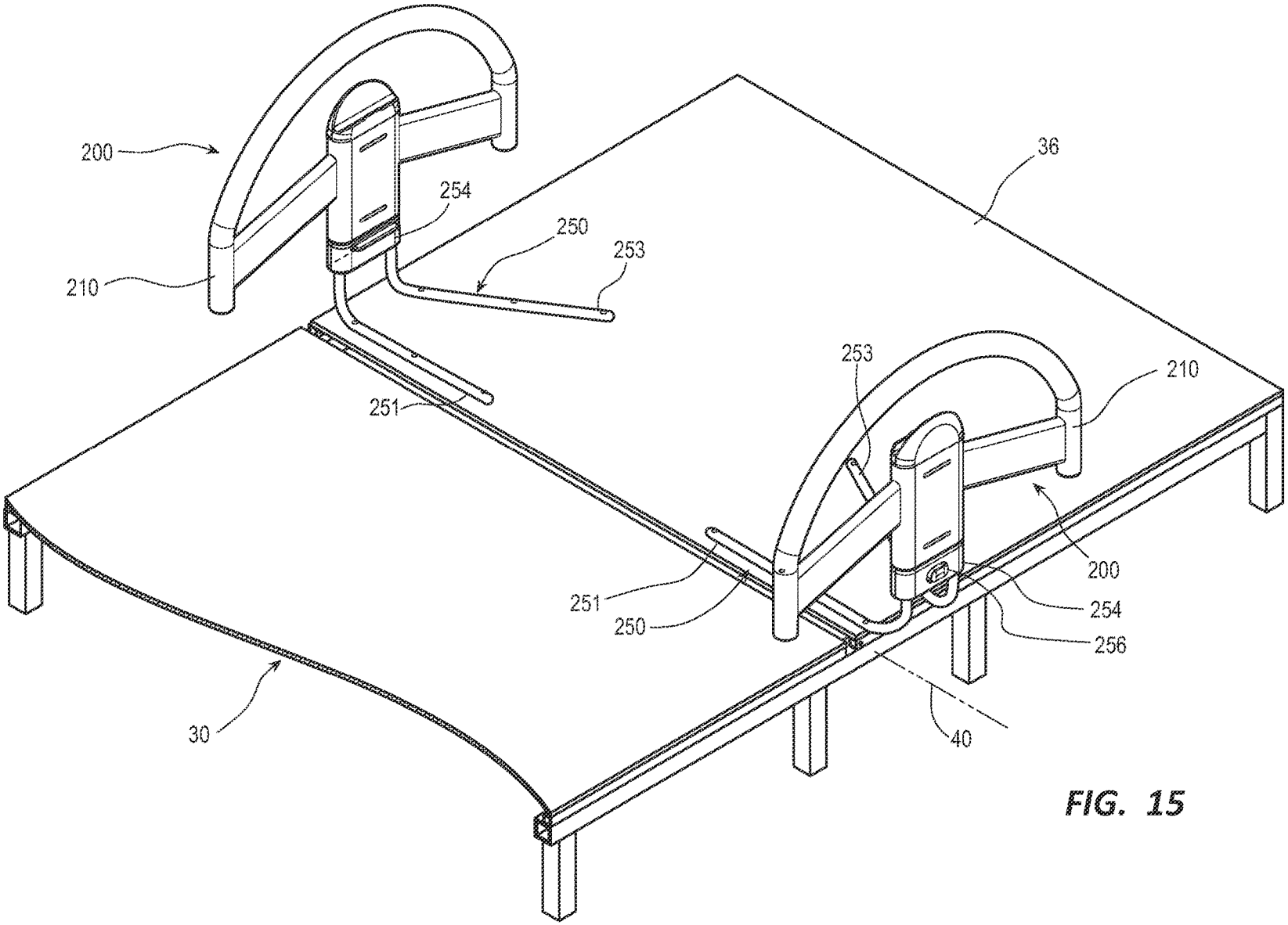
FIG. 15 is a perspective view of a first and a second bed handle coupled to a bed base through an embodiment of a first and a second base portion, respectively, with the bed base in an unarticulated state.

FIG. 15 depicts an embodiment of two mobility assistance devices 200 coupled to a bed base 36 of a bed 30. The mobility assistance device 200 resembles the mobility assistance device 100 described above in certain respects. Accordingly, like features are designated with like reference numerals, with the leading digits incremented to "2." For example, the embodiment depicted in FIGS. 15-16 includes a bed handle 210 that may, in some respects, resemble the bed handle 110 of FIGS. 1A and 2-14. Relevant disclosure set forth above regarding similarly identified features thus might not be repeated hereafter. Moreover, specific features of the mobility assistance device 100 and related components shown in FIGS. 1A-14 might not be shown or identified by a reference numeral in the drawings or specifically discussed in the written description that follows. However, such features may clearly be the same, or substantially the same, as features depicted in other embodiments and/or described with respect to such embodiments. Accordingly, the relevant descriptions of such features apply equally to the features of the mobility assistance device 200 and related components depicted in FIGS. 15-16. Any suitable combination of the features, and variations of the same, described with respect to the mobility assistance device 100 and related components illustrated in FIGS. 1A-14 can be employed with the mobility assistance devices 200 and related components of FIGS. 15-16, and vice versa. This pattern of disclosure applies equally to further embodiments depicted in subsequent figures and described hereafter, wherein the leading digits may be further incremented.

FIG. 15 omits a mattress from view for clarity of the depiction. The bed 30 may be an articulating bed. The mobility assistance device 200 may comprise a bed handle 210. In some embodiments, the bed handle 210 may be identical to the bed handle 110. In other embodiments, the bed handle 210 may be different from the bed handle 110, for example like the bed handles 110' and 110". The bed handle 210 may couple to a base portion 250 through a receiver 254. The receiver 254 may be similar in some respects to the receiver 154. For example, the receiver 254 may comprise a biasing member 256, such as a push button or a release button. The biasing member 256 may be similar in some respects to the biasing member 156. The base portion 250 may include legs 251, 253, such as support legs, which are configured to be placed between a mattress and a bed base 36 or box spring of a bed 30. The legs 251, 253 may be rods, tubes, bars, channels, or the like. The legs 251, 253 may be substantially straight, or may have some curvature. For example, the legs 251, 253 may extend from the receiver 254 in a substantially downward direction, then bend to approximately a right angle for positioning on the bed base 36. Or the legs 251, 253 may extend from the receiver 254 in a substantially horizontal direction without a bend.

The legs 251, 253 of the base portion 250 may include a perpendicular leg 251 and an angled leg 253. The legs 251, 253 of the base portion 250 may be secureable to the bed base 36 using fastening hardware, such as screws or bolts and nuts.

The perpendicular leg 251 and the angled leg 253 may both be configured to extend substantially in a plane parallel to a surface of the bed base 36, so as to be disposed under a mattress when the mattress is placed on the bed base 36. Thus, the perpendicular leg 251 and the angled leg 253 may rest substantially in a horizontal plane when the bed 30 is unarticulated.

The perpendicular leg 251 and the angled leg 253 together may form a "V" shape. A "V" shape may allow the base portion 250 to be coupled to the bed base 36 along two non-parallel directions, as depicted in FIG. 15. This may provide additional stability to the bed handle 210 over what would be achieved if the legs of the base portion were parallel. The perpendicular leg 251 and the angled leg 253 may be attached to the receiver 254 at adjacent locations on the receiver 254, or at offset locations on the receiver 254. The perpendicular leg 251 and the angled leg 253 may be formed from a single V-shaped member, or from multiple members. A base portion 250 with legs 251, 253 forming a "V" shape is essentially V-shaped, whether or not there is an offset between their attachment points to the receiver 254.

The perpendicular leg 251 may extend from the receiver 254 in a direction substantially perpendicular to the wide dimension of the receiver 254. In other words, the perpendicular leg 251 may extend substantially in a lateral direction of the bed 30 when the base portion 250 is coupled to the bed 30. In some embodiments, the perpendicular leg 251 may have a small angular offset from the lateral direction, such as approximately five degrees or less.

The base portion 250 should be installed on the bed 30 such that the legs 251, 253 do not cross an axis of rotation 40 of an articulating section of the bed 30. With the perpendicular leg 251 extending in a substantially lateral direction, the mobility assistance device 200 may be positioned appropriately near the axis of rotation 40, without the perpendicular leg 251 causing interference with articulation of the bed 30.

The angled leg 253 may extend from the receiver 254 with a significant angular offset from the perpendicular leg 251. Thus, the angled leg 253 may extend from the receiver 254 in a direction with both a substantial lateral component and a substantial longitudinal component. The angle between the perpendicular leg 251 and the angled leg 253 may be between twenty degrees and seventy degrees, including approximately thirty degrees, approximately forty-five degrees, or approximately sixty degrees. In some embodiments, a user may adjust the angle of the angled leg 253.

The angled leg 253 may extend—with its angular offset from the perpendicular leg 251—in a direction away from the axis of rotation 40 of an articulating section of the bed 30. For example, when the bed handles 210 of the mobility assistance devices 200 are installed over the axis of rotation 40 on the articulating section nearest to the head of the bed, the angled legs 253 may be oriented such that they extend from the receivers 254 with a lateral component towards the center of the bed 30, and a longitudinal component towards the head of the bed 30. By extending away from the axis of rotation 40, the angled leg 253 may avoid causing potential interference with articulation of the bed 30, while providing rigidity and stability to the mobility assistance device 200.

The perpendicular leg 251 and the angled leg 253 may be configurable so as to change the extent of the angle between them. The perpendicular leg 251 and the angled leg 253 may be configurable so as to change which leg is angled and which leg is perpendicular, allowing interchangeability for use of the base portion 250 on the opposite side of the bed 30.

Figure 16:
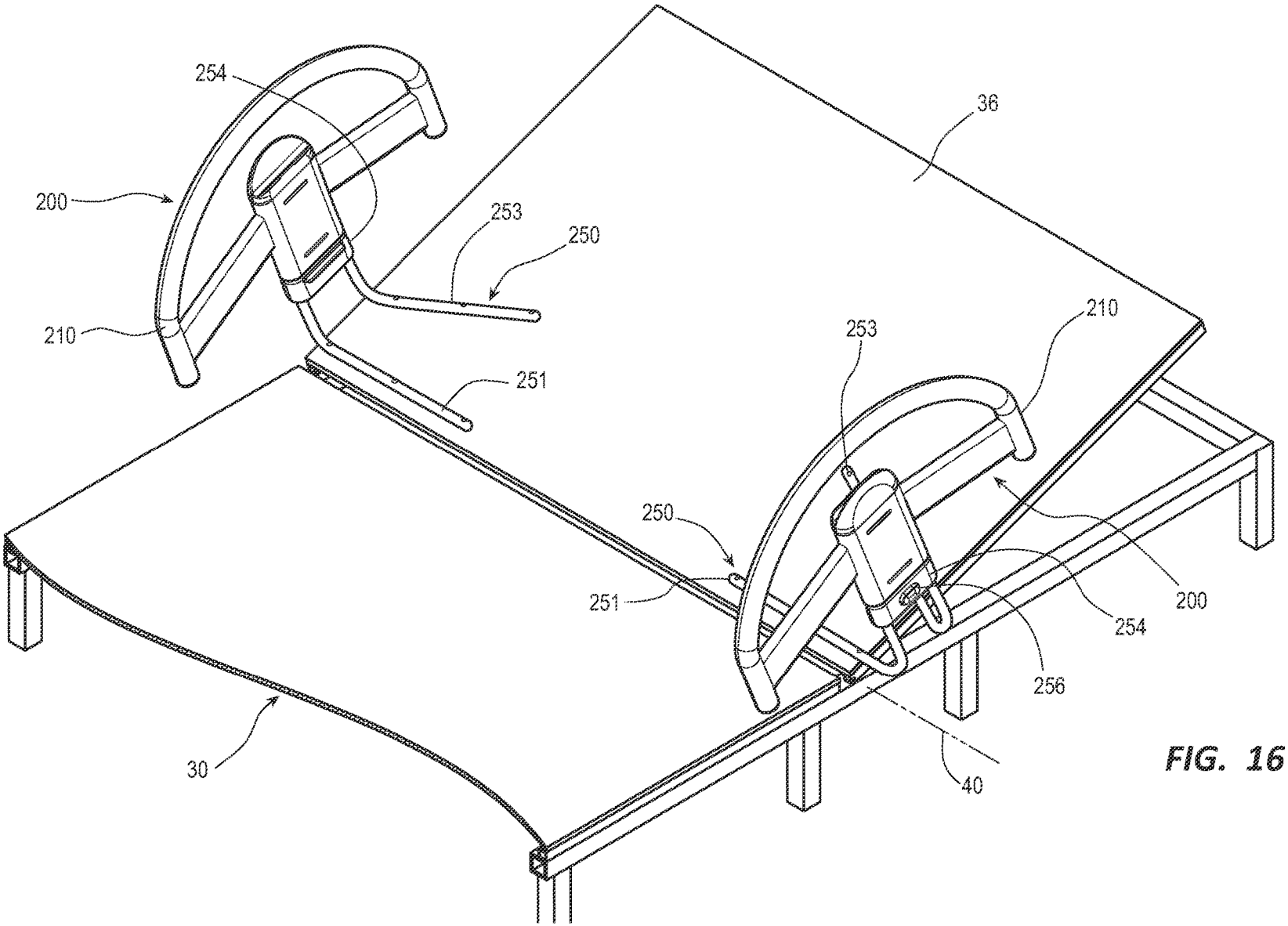
FIG. 16 is a perspective view of the bed handles, base portions, and bed base of FIG. 15, with the bed base in an articulated state.

FIG. 16 depicts the mobility assistance devices 200 of FIG. 15, with the bed 30 in an articulated state. As in FIG. 15, FIG. 16 omits a mattress from view for clarity. As can be seen in FIG. 16, the mobility assistance devices 200 may be coupled to the bed base 36 at locations where the bed handles 210 are disposed over an axis of rotation 40. Thus, a portion of the bed handle 210 may be on a headboard side of the axis of rotation 40, and a portion of the bed handle 210 may be on a footboard side of the axis of rotation 40.

The bed handles 210 may be sized to be used with a particular thickness or range of thicknesses of the mattress. For example, one embodiment of the bed handle 210 may have a length and a height suitable for use with an eight-inch-thick mattress, while another embodiment of the bed handle 210 may have a length and a height suitable for use with a twelve-inch-thick mattress.

FIG. 16 illustrates that the base portions 250 do not interfere with articulation of the bed 30.

Figure 17A:
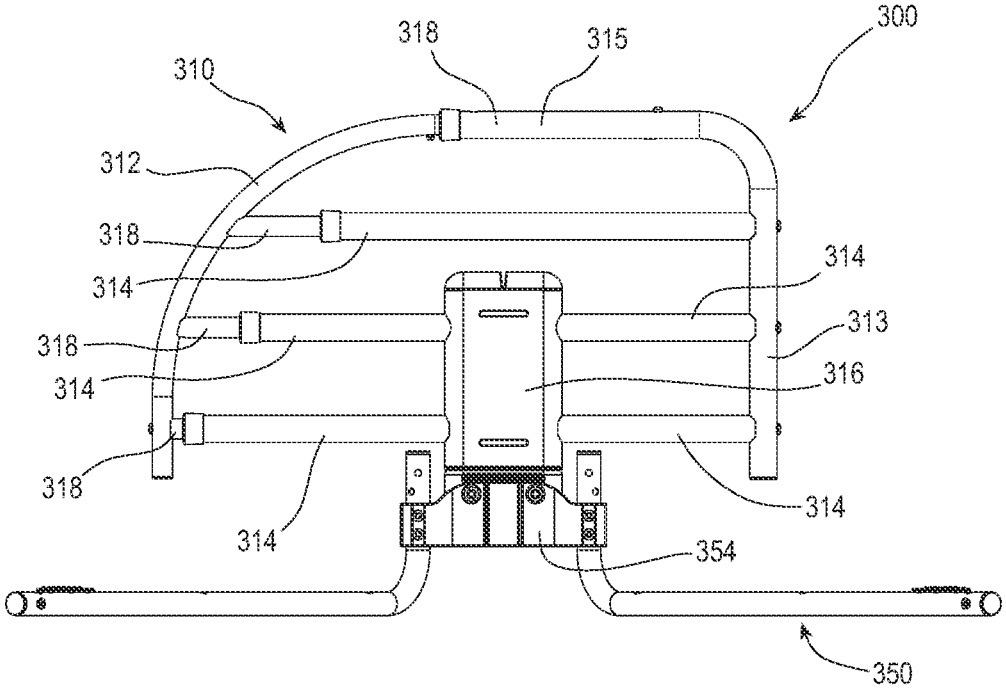
FIG. 17A is a side view of an embodiment of a bed handle, with a gripping member and telescoping members in a collapsed configuration.

FIG. 17A depicts an embodiment of a mobility assistance device 300 with a bed handle 310. The bed handle 310 may have a gripping member 312 on one side (a longitudinal side when the bed handle 310 is installed on a bed). The gripping member 312 may comprise a substantially arcuate shape. The gripping member 312 may extend along at least a portion of a length of the bed handle 310. The opposite longitudinal side of the bed handle 310 may have a straight-line segment 315 joined with a vertical portion 313. The gripping member 312 may be coupled to the straight-line segment 315. The straight-line segment 315 and the vertical portion 313 may serve the user of the mobility assistance device 300 for gripping purposes, similar to the gripping member 312. The bed handle 310 therefore has a gripping member 312 comprising a substantially arcuate shape on one longitudinal end, and a component comprising a substantially rectangular shape on the opposite longitudinal end.

In the depicted embodiment, the straight-line segment 315 is joined with the vertical portion 313 as a unitary component with a rounded corner. In some embodiments, the straight-line segment 315 and the vertical portion 313 may be separate components coupled together. In some embodiments, the gripping member 312 and the straight-line segment 315 may be the same unitary component.

As shown in FIG. 17A, the gripping member 312 may be coupled to one or more telescoping members 318, and the vertical portion 313 may be coupled to one or more support members 314. In the illustrated embodiment, the gripping member 312 is attached to four telescoping members 318, and the vertical portion 313 is attached to three support members 314. As shown, two of the support members 314 are coupled to a stem 316. These two support members 314 may pass through the stem 316 as unitary components, or they may each be split into separate components on either longitudinal side of the stem 316.

The mobility assistance device 300 may have a base portion 350. The stem 316 of the bed handle 310 may be coupleable to a receiver 354 of the base portion 350, in similar fashion as the stem 116 of the bed handle 110 is coupleable to the receiver 154 of the base portion 150.

The telescoping members 318 may be configured to slide in or out of the support members 314 or the straight-line segment 315 in telescopic fashion. In this manner, the longitudinal length of the bed handle 310 may be decreased or increased. In some embodiments, expansion and/or contraction of the telescoping members 318 in or out of the support members 314 or the straight-line segment 315 may occur while the mobility assistance device 300 is mounted on a bed.

One or more of the telescoping members 318 may be lockable in place at various longitudinal positions using a push button pin (a tubing button) or some other mechanism that uses a spring clip to lock the button pin in place. The view depicted in FIG. 17A depicts the telescoping members 318 fully inserted into the support members 314 and the straight-line segment 315 in a collapsed configuration of the bed handle 310.

Figure 17B:
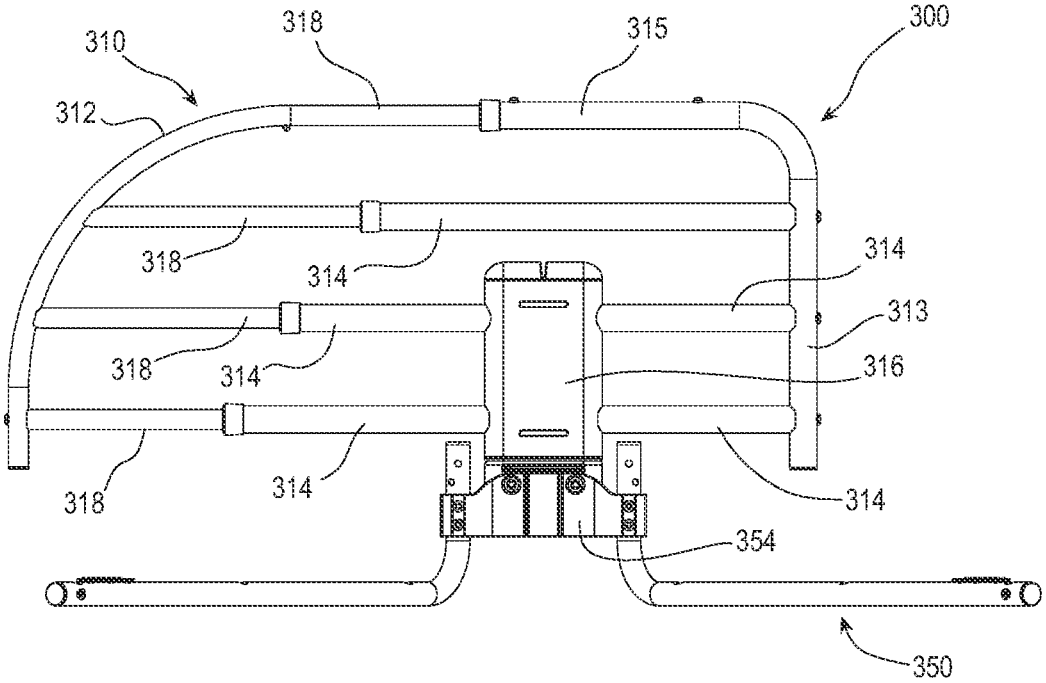
FIG. 17B is a side view of the embodiment of the bed handle of FIG. 17A, with the gripping member and telescoping members in an expanded configuration.

FIG. 17B depicts the mobility assistance device 300 of FIG. 17A, with the telescoping members 318 fully extended from the support members 314 and the straight-line segment 315 in an expanded configuration of the bed handle 310. As discussed above, the mobility assistance device 300 may comprise partially extended positions that would be between the collapsed configuration of FIG. 17A and the fully extended configuration of FIG. 17B.

Figure 18:
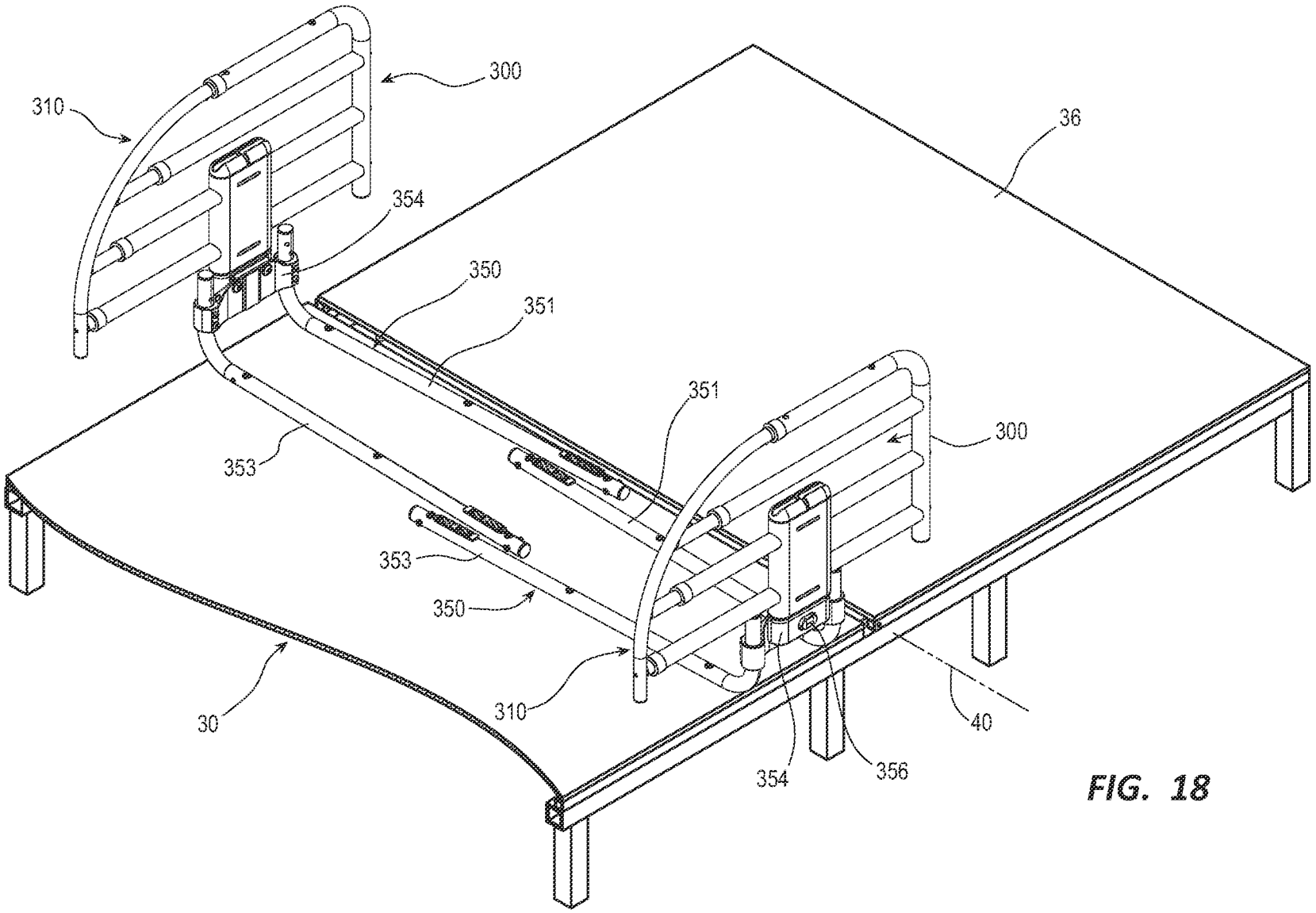
FIG. 18 is a perspective view of a first and a second bed handle according to the embodiment of FIG. 17A coupled to a nonarticulating section of an articulating bed base through a first and a second base portion, respectively, with the bed base in an unarticulated state.

FIG. 18 depicts a first mobility assistance device 300 and a second mobility assistance device 300, each mounted to a nonarticulating section of a bed base 36 of an articulating bed 30 with the bed base 36 in an unarticulated state. The mobility assistance devices 300 are each mounted to the bed base 36 through a first and a second base portion 350, respectively.

As shown in FIG. 18, the base portions 350 may each have two legs 351, 353. The first leg 351 is positioned near the axis of rotation 40, while the second leg 353 is positioned further from the axis of rotation 40. In this depiction, both legs 351, 353 are oriented such that they extend from the receiver 354 in a direction substantially perpendicular to a wide dimension of the receiver 354. In other words, the legs 351, 353 may extend substantially in a lateral direction of the bed 30 when the base portion 350 is coupled to the bed 30.

The legs 351, 353 may be configurable so as to position one or both legs at an angular offset from the lateral direction. When the base portion 350 is used on an articulating bed, and near an axis of rotation of an articulating section of the articulating bed, the leg 351 adjacent the axis of rotation may be positioned substantially perpendicular to the wide dimension of the receiver 354 (i.e., substantially in a lateral direction) so as not to interfere with the articulating motion of the articulating section. Also, the legs 351, 353 may be configurable so as to change which leg is angled and which leg is perpendicular, allowing interchangeability for use of the base portion 350 on the opposite side of the bed 30.

Also shown in FIG. 18 is a biasing member 356 on the receiver 354. The biasing member 356 may function in similar fashion to the biasing member 156 on the receiver 154.

Figure 19:
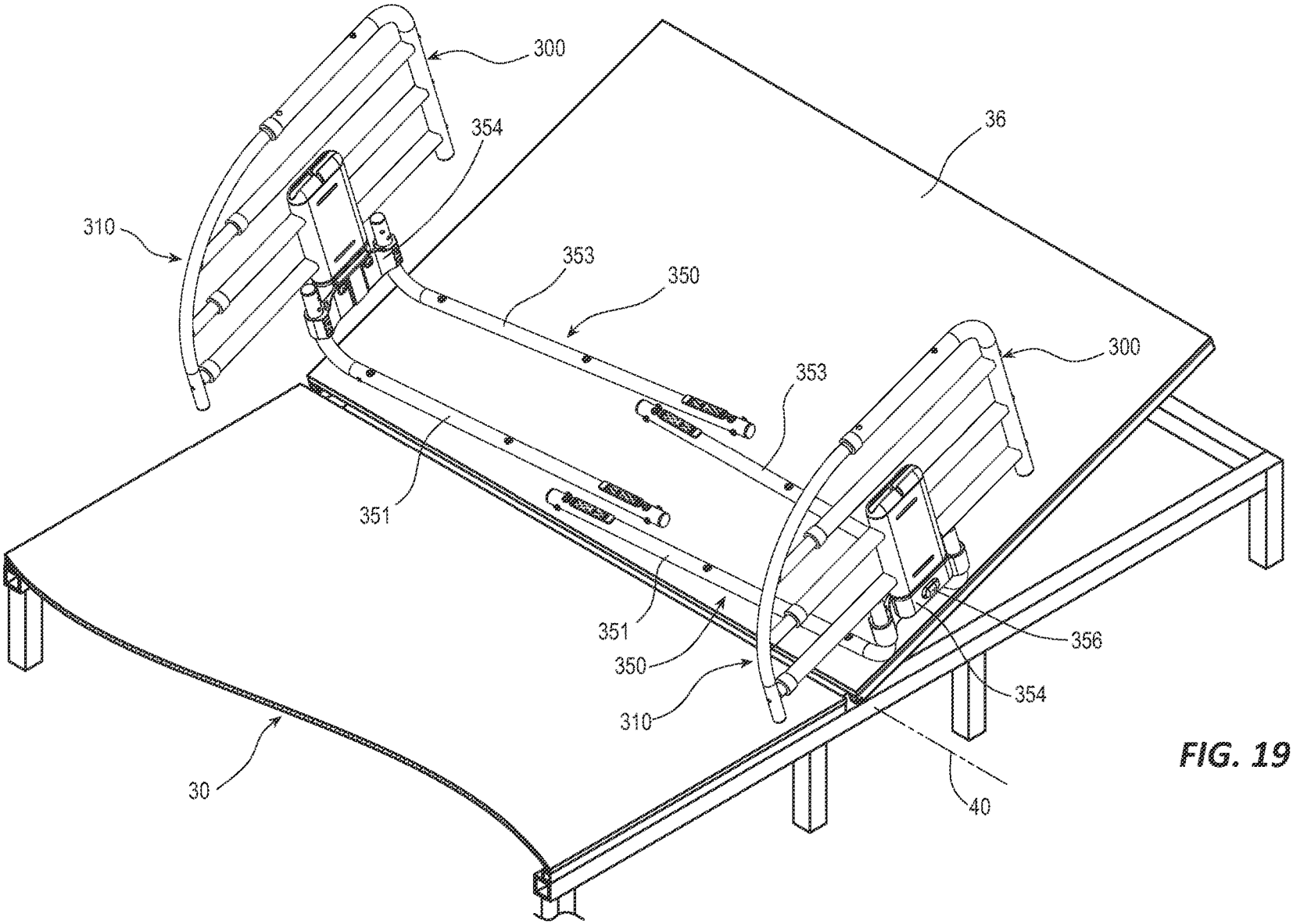
FIG. 19 is a perspective view of a first and a second bed handle according to the embodiment of FIG. 17A coupled to an articulating section of an articulating bed base through a first and a second base portion, respectively, with the bed base in an articulated state.

FIG. 19 depicts a first mobility assistance device 300 and a second mobility assistance device 300. In this view, the mobility assistance devices 300 are mounted to an articulating section of the bed base 36 of the articulating bed 30 with the bed 30 in an articulated state. In this configuration, the legs 351, 353 of the base portions 350 extend substantially in lateral directions of the bed 30. The base portions 350 may be configurable to position the legs 353 further from the axis of rotation 40 of the articulating section with an angular offset from the lateral direction, similar to the embodiments depicted in FIG. 16.

Figure 20:
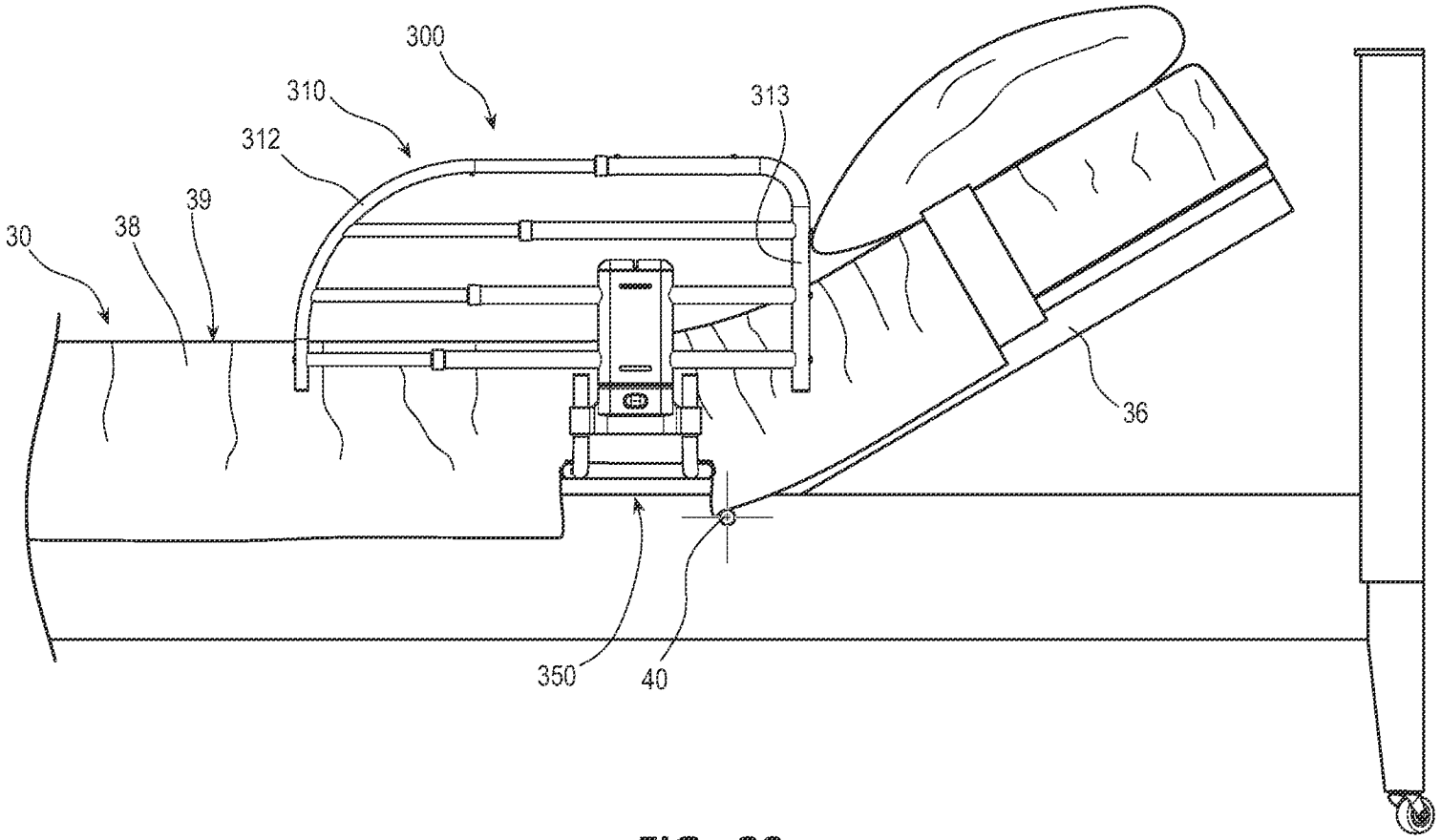
FIG. 20 is a side view of the bed handle of FIG. 17B coupled to a nonarticulating section of an articulating bed base through a base portion, with the bed base in an articulated state.

FIG. 20 depicts a bed handle 310 mounted on a nonarticulating section of an articulating bed 30 through a base portion 350, with the bed 30 in an articulated state. On the aft longitudinal side of the bed handle 310, an external lateral angle between the gripping member 312 and an upper surface 39 of the mattress 38 is obtuse or right, and remains obtuse or right (but not acute) throughout articulation of the bed 30. On the forward longitudinal side of the bed handle 310, an external lateral angle between the vertical portion 313 and an upper surface of the mattress 38 is acute. However, this acute external lateral angle may not present a serious risk of entrapment because the vertical portion 313 remains in a vertical orientation (because the bed handle 310 is mounted on a nonarticulating section of the bed 30), and the location of the acute external lateral angle may be an unlikely location where a user of the mobility assistance device 300 would become entrapped. Further, because a portion of the bed handle 310 is not disposed above the acute external lateral angle formed on the forward longitudinal side of the bed handle 310, a user may easily lift a potentially entrapped appendage or body part upwards to escape entrapment.

Figure 21:
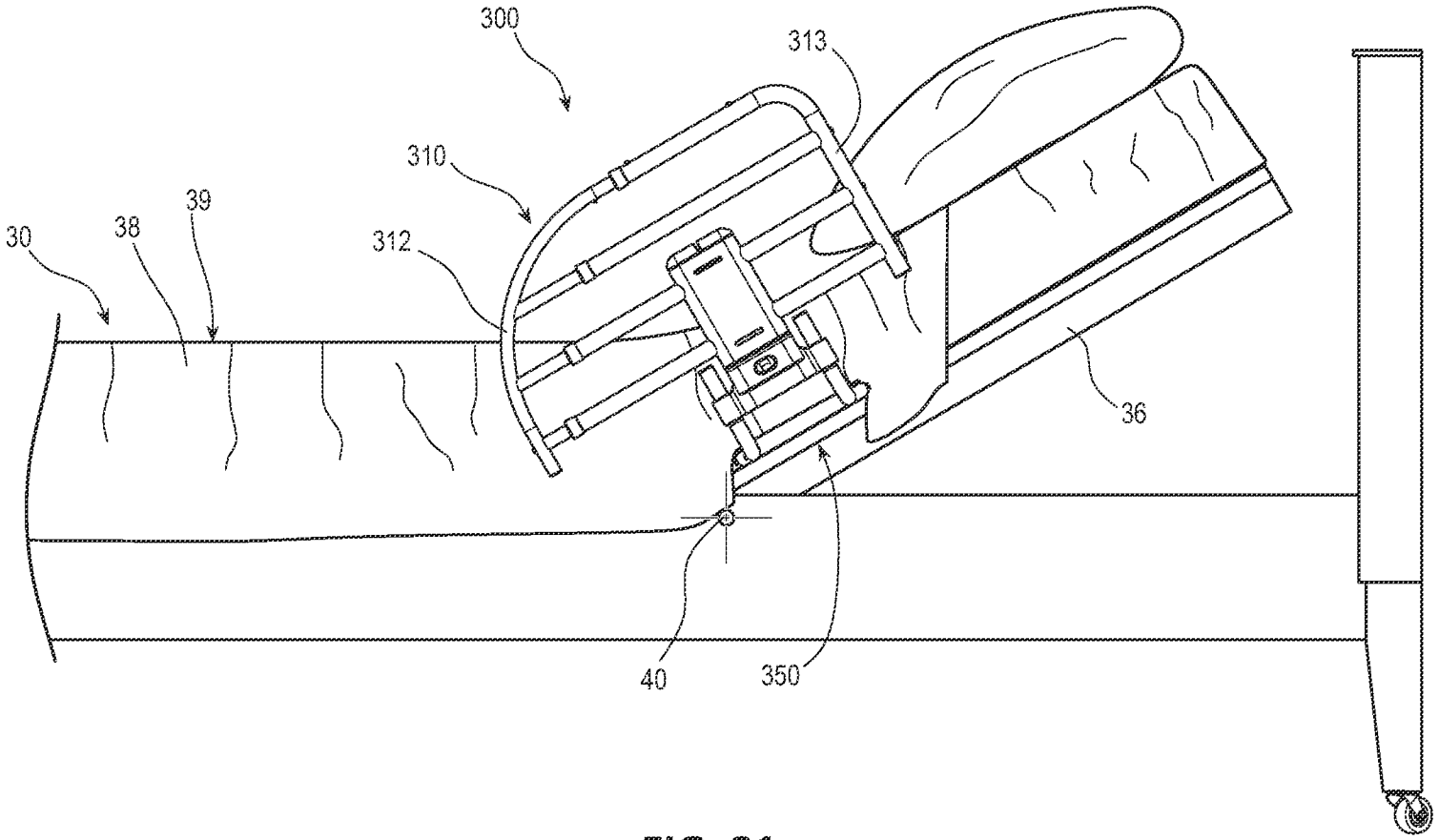
FIG. 21 is a side view of the bed handle of FIG. 17A coupled to an articulating section of an articulating bed base through a base portion, with the bed base in an articulated state.

FIG. 21 depicts a bed handle 310 mounted on an articulating section of an articulating bed 30 through a base portion 350, with the bed 30 in an articulated state. On the aft longitudinal side of the bed handle 310, an external lateral angle between the gripping member 312 and an upper surface 39 of the mattress 38 is obtuse or right, but not acute. Due to the substantially arcuate shape of the gripping member 312, the external lateral angle may remain obtuse or right (but not acute) for any angle of articulation of the bed 30. On the forward longitudinal side of the bed handle 310, an external lateral angle between the vertical portion 313 (which does not remain oriented vertically as the bed 30 articulates) and an upper surface of the mattress 38 is a right angle. This external lateral angle remains right for any angle of articulation of the bed 30. Thus, on each longitudinal side of the bed handle 310, entrapment risk can be mitigated or avoided because there are no acute external lateral angles.

Figure 22C:
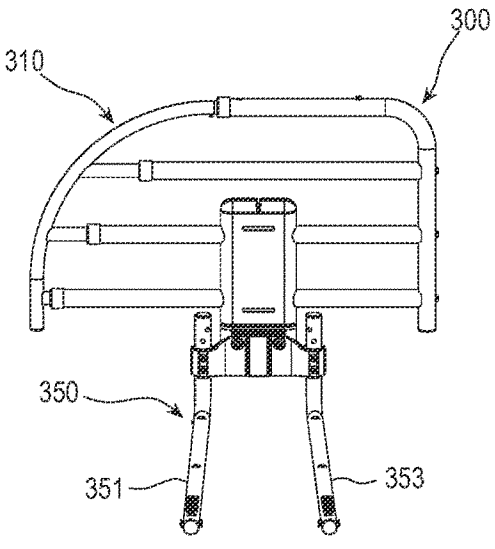
FIG. 22C is a side elevation view of the bed handle of FIG. 17A, with a base portion having two legs in a configuration with each leg extending substantially in a lateral direction.
Figure 22B:
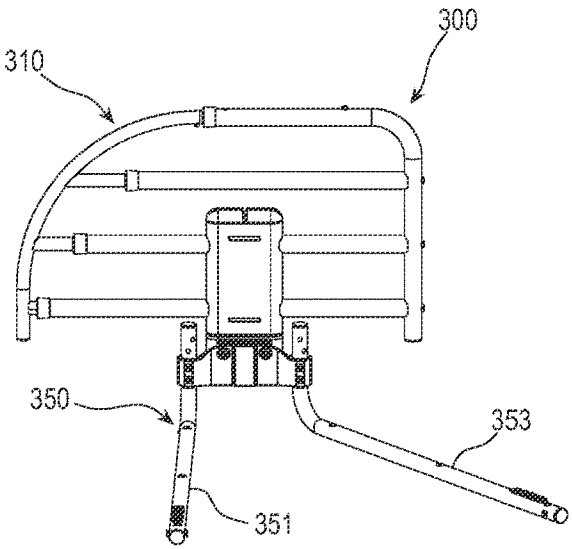
FIG. 22B is a side elevation view of the bed handle of FIG. 17A, with a base portion having two legs in a configuration with one leg extending forward at an angle from the lateral axis, and another leg extending substantially in a lateral direction.
Figure 22A:
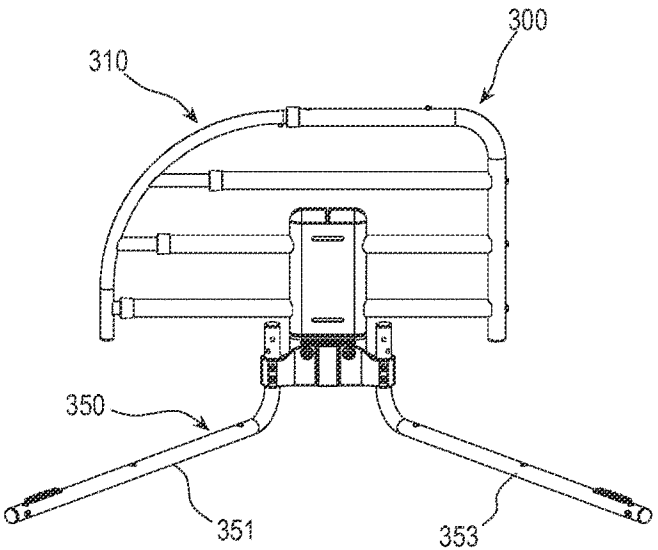
FIG. 22A is a side elevation view of the bed handle of FIG. 17A, with a base portion having two legs in a configuration with one leg extending forward at an angle from the lateral axis, and another leg extending aft at an angle from the lateral axis.

FIG. 22A depicts the mobility assistance device 300 with the bed handle 310 and base portion 350. The base portion 350 as depicted has two legs 351, 353 in a configuration with one leg 351 extending from the receiver 354 aft at an angle from the lateral axis, and another leg 353 extending from the receiver 354 forward at an angle from the lateral axis. This configuration is particularly useful on regular beds. The angular offset (the "V" shape) of the legs 351, 353 may provide additional stability to the mobility assistance device 300 over what would otherwise be achieved if one or both legs 351, 353 were not so angled. In the illustrated embodiment, the angles relative to the lateral axis of both legs 351, 353 have the same magnitude. In some embodiments, the angles relative to the lateral axis of the legs 351, 353 may have different magnitudes. In some embodiments, the angles of each leg 351, 353 may be adjusted by the user.

FIG. 22B depicts the mobility assistance device 300 with the bed handle 310 and base portion 350. The base portion 350 has two legs 351, 353. As depicted, a perpendicular leg 351 may extend from the receiver 354 in a substantially lateral direction, while an angled leg 353 may extend from the receiver 354 at a significant angular offset from the perpendicular leg 351. This configuration is particularly useful on articulating beds. The angular offset (the "V" shape) of the angled leg 353 from the perpendicular leg 351 may provide stability to the mobility assistance device 300, while the perpendicular leg 351 remains clear of the axis of rotation of the articulating section of the bed.

FIG. 22C depicts the mobility assistance device 300 with the bed handle 310 and base portion 350. The base portion 350 as depicted has two legs 351, 353 that extend in a substantially lateral direction.

The base portion 350 may be configurable, such that the legs 351, 353 may be positioned according to the needs of a particular use of the mobility assistance device 300. Thus, the configurations of the base portion 350 depicted in FIGS. 22A-22C may be achieved with a single embodiment. Alternatively, the base portion 350 may be constructed to be unconfigurable, such that the legs 351, 353 are fixed in predetermined positions.

Any methods disclosed herein include one or more steps or actions for performing the described method. The method steps and/or actions may be interchanged with one another. In other words, unless a specific order of steps or actions is required for proper operation of the embodiment, the order and/or use of specific steps and/or actions may be modified. Moreover, sub-routines or only a portion of a method described herein may be a separate method within the scope of this disclosure. Stated otherwise, some methods may include only a portion of the steps described in a more detailed method.

Reference throughout this specification to "an embodiment" or "the embodiment" means that a particular feature, structure, or characteristic described in connection with that embodiment is included in at least one embodiment. Thus, the quoted phrases, or variations thereof, as recited throughout this specification are not necessarily all referring to the same embodiment.

Similarly, it should be appreciated by one of skill in the art with the benefit of this disclosure that in the above description of embodiments, various features are sometimes grouped together in a single embodiment, figure, or description thereof for the purpose of streamlining the disclosure. This method of disclosure, however, is not to be interpreted as reflecting an intention that any claim requires more features than those expressly recited in that claim. Rather, as the following claims reflect, inventive aspects lie in a combination of fewer than all features of any single foregoing disclosed embodiment. Thus, the claims following this Detailed Description are hereby expressly incorporated into this Detailed Description, with each claim standing on its own as a separate embodiment. This disclosure includes all permutations of the independent claims with their dependent claims.

Recitation in the claims of the term "first" with respect to a feature or element does not necessarily imply the existence of a second or additional such feature or element. It will be apparent to those having skill in the art that changes may be made to the details of the above-described embodiments without departing from the underlying principles of the present disclosure.

We claim:

1. A mobility assistance device comprising:

a base portion configured to couple to an articulating section of an articulating bed; and a bed handle coupleable to the base portion, the bed handle comprising a gripping member that extends along at least a portion of a length of the bed handle;

wherein when the base portion is coupled to the articulating section in active articulation, the gripping member is configured such that external lateral angles on at least one longitudinal side of the bed handle between the gripping member and an upper surface of a mattress of the articulating bed remain obtuse throughout active articulation of the articulating section of the articulating bed; and wherein the external lateral angles are formed by a plane that is tangent to the upper surface of the mattress and a plane that is tangent to the gripping member where the upper surface of the mattress and the gripping member intersect.

2. The mobility assistance device of claim 1, wherein the base portion comprises a receiver that couples the bed handle to the base portion.

3. The mobility assistance device of claim 2, wherein the receiver is releasably couplable to the bed handle through engagement of a biasing member.

4. The mobility assistance device of claim 1, wherein the base portion is configured to couple to a frame of the articulating bed at three or more points.

5. The mobility assistance device of claim 1, wherein the gripping member comprises a substantially arcuate shape at a location along the gripping member that is configured to abut the upper surface of the mattress.

6. The mobility assistance device of claim 5, wherein the substantially arcuate shape comprises a curve.

7. The mobility assistance device of claim 1, wherein the bed handle further comprises a stem attached to a support member, with the support member attached to the gripping member.

8. The mobility assistance device of claim 7, wherein the gripping member is unobstructed by the support member for gripping along the length of the bed handle.

9. The mobility assistance device of claim 1, wherein the bed handle is further configured to restrict passage of a 120-millimeter-diameter cylinder through openings in the bed handle.

10. A mobility assistance device configured to be secured to an articulating bed, the mobility assistance device comprising:

a base portion configured to couple to an articulating section of an articulating bed; and a bed handle coupleable to the base portion;

wherein when the base portion is coupled to the articulating section in active articulation, the active articulation of the articulating section of the articulating bed does not cause an acute external lateral angle to form between the bed handle and an upper surface of a mattress of the articulating bed on at least one longitudinal side of the bed handle, and wherein the external lateral angles are formed by a plane that is tangent to the upper surface of the mattress and a plane that is tangent to the bed handle where the upper surface of the mattress and the bed handle intersect.

11. The mobility assistance device of claim 10, wherein the base portion is essentially V-shaped.

12. The mobility assistance device of claim 10, wherein the bed handle comprises a gripping member of substantially arcuate shape.

13. A mobility assistance device comprising:

a base portion configured to be disposed under a mattress of an articulating bed; and a bed handle couplable to the base portion;

wherein the bed handle is configured to be disposed directly above an axis of rotation of an articulating section in active articulation of the articulating bed, with a first portion of the bed handle disposed on a first side of the axis of rotation and a second portion of the bed handle disposed on a second side of the axis of rotation, wherein an obtuse angle is configured to be formed by a plane that is tangent to an upper surface of the mattress and a plane that is tangent to the bed handle where the upper surface of the mattress and the bed handle intersect, and wherein the obtuse angle remains obtuse throughout active articulation of the articulating section of the articulating bed.

14. The mobility assistance device of claim 13, wherein the first side is a headboard side and the second side is a footboard side.

15. The mobility assistance device of claim 13, wherein articulation of the articulating section does not cause an acute external lateral angle to form between the bed handle and the upper surface of the mattress on the longitudinal side of the bed handle adjacent the second portion.

16. The mobility assistance device of claim 13, wherein the base portion comprises a first leg configured to extend substantially in a lateral direction of the articulating bed when the first leg is disposed under the mattress, and wherein the base portion further comprises a second leg configured to extend at an angle from the first leg and away from the axis of rotation of the articulating section of the articulating bed when the second leg is disposed under the mattress.

17. The mobility assistance device of claim 13, wherein a gripping member of the bed handle is unobstructed for gripping across a wide range of points in any articulated state of the articulating bed.

18. The mobility assistance device of claim 13, wherein the second portion comprises a substantially arcuate shape.

19. The mobility assistance device of claim 18, wherein the first portion comprises a substantially rectangular shape.

20. The mobility assistance device of claim 13, wherein the bed handle comprises at least one telescoping member coupled with at least one support member.

* * * * *